US006224332B1

(12) United States Patent
Leach et al.

(10) Patent No.: US 6,224,332 B1
(45) Date of Patent: May 1, 2001

(54) APPARATUS AND METHODS FOR INSTALLING, REMOVING AND ADJUSTING AN INNER TURBINE SHELL SECTION RELATIVE TO AN OUTER TURBINE SHELL SECTION

(75) Inventors: David Leach, Niskayuna; Peter Allen Bergendahl, Scotia, both of NY (US); Stuart Forrest Waldo, Salem, NC (US); Robert Leroy Smith; Robert Kim Phelps, both of Milford, OH (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/311,642

(22) Filed: May 14, 1999

(51) Int. Cl.[7] ..... F01D 25/24

(52) U.S. Cl. ..... 415/126; 415/213.1; 415/214.1

(58) Field of Search ..... 415/126, 128, 415/118, 136, 213.1, 214.1; 29/889.1, 402.04, 464; 269/47, 296

(56) References Cited

U.S. PATENT DOCUMENTS 3,493,212 * 2/1970 Scalzo et al. ..... 415/127
3,628,884 * 12/1971 Mierley ..... 415/213.1
4,491,307 * 1/1985 Ellefson ..... 269/55
4,925,363 * 5/1990 Brown et al. ..... 415/129
5,779,442 7/1998 Sexton et al. .

* cited by examiner

*Primary Examiner*—Edward K. Look
*Assistant Examiner*—James M. McAleenan
(74) *Attorney, Agent, or Firm*—Nixon & Vanderhye

(57) ABSTRACT

A turbine includes upper and lower inner shell sections mounting the nozzles and shrouds and which inner shell is supported by pins secured to a surrounding outer shell. To disassemble the turbine for access to the inner shell sections and rotor, an alignment fixture is secured to the lower outer shell section and has pins engaging the inner shell section. To disassemble the turbine, the inner shell weight is transferred to the lower outer shell section via the alignment fixture and cradle pins. Roller assemblies are inserted through access openings vacated by support pins to permit rotation of the lower inner shell section out of and into the lower outer shell section during disassembly and assembly. The alignment fixture includes adjusting rods for adjusting the inner shell axially, vertically, laterally and about a lateral axis. A roller over-cage is provided to rotate the inner shell and a dummy shell to facilitate assembly and disassembly in the field.

23 Claims, 26 Drawing Sheets

APPARATUS AND METHODS FOR INSTALLING, REMOVING AND ADJUSTING AN INNER TURBINE SHELL SECTION RELATIVE TO AN OUTER TURBINE SHELL SECTION

The Government of the United States of America has rights in this invention pursuant to COOPERATIVE AGREEMENT NO. DE-FC21-95MC31176 awarded by the U.S. Department of Energy.

TECHNICAL FIELD

The present invention relates generally to gas turbines and particularly to gas turbines having inner and outer turbine shell sections. More particularly, the present invention relates to apparatus and methods for installing and aligning the inner shell relative to the outer shell during initial assembly of the turbine, as well as removing the inner shell for maintenance and repair of component parts of the rotor and shell sections in the field and reinstalling the inner shell.

In U.S. Pat. No. 5,779,442, there is disclosed a gas turbine comprised of inner and outer shells. The inner shell carries the first and second-stage nozzles and shrouds, while the outer shell provides structural support therefor as well as support for the nozzles and shrouds of additional stages. Each of the inner and outer shells is comprised of semi-cylindrical upper and lower shell sections joined one to the other along respective horizontal splitlines. As outlined in that patent, the nozzles of the first and second stages are cooled by flowing a thermal medium into and out of the nozzles.

Access to the hot gas path components of the turbine, without removal of the rotor within the inner shell, is accomplished in that patent by disconnecting and removing various piping and fittings associated with the cooling circuit, inserting rollers through access openings in the lower outer shell to transfer the weight of the inner shell to the rollers, removing the pins mounting the inner shell to the outer shell and then removing the upper outer shell, exposing the upper inner shell section for removal. Upon disconnecting the upper inner shell section from the lower inner shell section along the horizontal splitline, the upper inner shell section including its nozzle, shroud and associated piping, can be removed from the turbine, exposing the underlying sections of the rotor. A simulated dummy shell section is then secured to the lower inner shell section at its splitline and the dummy shell and lower inner shell section are rotated 180° to locate the inner shell section above the lower outer shell section. By removing this second inner shell section, the complete inner shell can be removed for maintenance and repair without removal of the rotor.

In that patent, there is also disclosed a rolling fixture which is disposed on the lower outer shell section to facilitate removal and installation of the inner shell relative to the outer shell. The fixture mounts a winch by which the dummy shell section and lower inner shell section can be rotated about the rotor axis to facilitate removal of the lower shell section.

As will also be appreciated from a review of that patent, the inner and outer shells are connected to one another by a pair of axially spaced circumferential arrays of pins interconnecting the inner and outer shells. The pins project radially outwardly from the inner shell and have opposite circumferentially facing flats which cooperate with adjusting screws mounted on the outer shell to adjust the inner shell relative to the outer shell in a plane normal to the axis of rotation.

A new and more advanced gas turbine design has been developed by the assignee hereof which employs axially spaced arrays of rectilinear sockets about the inner shell. Pins projecting from the outer shell into the sockets to support the inner shell from the outer shell and in coaxial alignment with the rotor axis. For a complete disclosure of the geometry of the pins, reference is made to co-pending patent application Ser. No. 08/313,362, of common assignee herewith, the disclosure of which is incorporated herein by reference. These latter support pins are not adjustable by adjusting screws carried by the outer shell as in assignee's prior U.S. Pat. No. 5,779,442. There has thus developed a need for a system for installing and removing the inner shell sections relative to the outer shell and aligning the inner shell relative to the outer shell upon installation.

BRIEF SUMMARY OF THE INVENTION

In accordance with a preferred embodiment of the present invention, there is provided apparatus and methods for field removal of the inner shell relative to the outer shell without removal of the rotor and for reinstalling new or repaired inner shell sections without removal of the rotor and aligning the inner shell relative to the rotor axis in both radial and axial directions. To accomplish the foregoing, it will be appreciated that the inner and outer shells are connected one to the other by axially spaced, circumferential fore and aft arrays of support pins bolted to the outer shell at locations generally spaced 45° from one another about the outer shell and projecting radially inwardly for reception in recesses at corresponding locations along the inner shell. While eight support pins at each fore and aft axial location are preferred, a few or greater number of support pins may be used and with different circumferential spacing therebetween. For purposes of the present description and convenience only, the location of the pins is described in approximate clock positions about the rotor axis as viewed axially. To remove the inner shell, the support pins at the 5 and 7 o'clock positions, both fore and aft, are removed. An alignment fixture is then attached to and suspended from the lower outer shell section. The alignment fixture generally comprises a rectangular frame having left and right-hand outer shell mounts secured to the lower outer shell section on opposite sides of the rotor axis. The outer shell mounts connect with a depending rectangular frame by respective pairs of alignment rods on each side of the alignment fixture whereby the rectangular frame is supported solely by the pairs of alignment rods. Additionally, a pair of axially extending alignment rods interconnect the rectangular frame and the mounts and a lateral or transversely extending alignment rod interconnects the frame and one of the mounts. The rectangular frame also includes two pairs of cradle pins mounted on inclined tracks for engagement through the lower outer shell section support pin openings at the 5 and 7 o'clock positions and with the recesses in the inner shell normally mounting the support pins interconnecting the inner and outer shells. With the rectangular frame suspended from the mounts secured to the lower outer shell section, and with the cradle pins engaging in the openings of the inner shell, it will be appreciated that the entire weight of the inner shell can be transferred to the cradle pins and supported from the lower outer shell section through the rectangular frame, vertical adjusting rods and mounts.

With the mounts secured to the lower outer shell section and the cradle pins inserted into the recesses of the inner shell, the forward and aft support pins interconnecting the upper outer shell section and the upper inner shell section to one another are removed. Upon removal of the upper support pins, the upper outer shell section is removed, lifting it from the lower outer shell section at the horizontal splitline. Next, the upper inner shell section is removed. The remaining support pins at the 4 and 8 o'clock positions, both fore and aft, are then removed whereby the weight of the lower inner shell section is wholly transferred to the cradle pins, supported in turn through the alignment structure by the lower outer shell section.

To remove the lower inner shell section, roller assemblies are secured to the lower outer shell section. The rollers thereof engage the inner shell at the 4 and 8 o'clock positions. The cradle pins are then backed off, transferring the weight of the lower inner shell section to the lower outer shell section through the roller assemblies. Additional roller assemblies are then secured to the outer shell at the 5 and 7 o'clock positions with their rollers engaging the lower inner shell section. A dummy inner shell section is secured on the lower inner shell section at the splitline. A roller cage is then attached to the lower outer shell section and the dummy shell section and lower inner shell section are jointly rotated 180° to locate the inner shell section along the open top of the turbine. With the removal of the roller cage, the repositioned inner shell section can then be removed, fully exposing the first and second stages of the rotor. As detailed in the following description, the installation of the inner shell sections follows a reverse procedure.

The alignment fixture of the present invention may also be used for factory installation of the inner shell relative to the outer shell when fabricating a complete turbine. With the lower outer shell section elevated and supported, roller assemblies are inserted at the 4 and 8 o'clock positions of the lower outer shell. The lower inner shell section is then lowered into the lower outer shell section for support on the roller assemblies. The alignment fixture is then secured to the lower outer shell section and the cradle pins displaced to engage the lower inner shell section. The rotor is then placed and secured in the turbine. The upper inner shell section is then secured at the horizontal splitline to the lower inner shell section. Upon removal of the roller assemblies, the weight of the entire inner shell is then transferred to the cradle pins and hence to the lower outer shell section through the alignment fixture. With the inner shell supported in the lower outer shell section by the alignment fixture, the adjusting rods of the alignment fixture are manipulated to position the inner shell relative to the lower outer shell section laterally, axially, vertically and about a transverse axis. Once aligned, the upper outer shell section is secured to the lower outer shell section at the horizontal splitline. The support pins are then inserted at all pin opening locations except for the 5 and 7 o'clock locations containing the cradle pins. The weight of the inner shell is thus transferred to the support pins and the alignment fixture is removed. A final pair of fore and aft support pins are secured to the lower outer shell section at the 5 and 7 o'clock positions in supporting relation to the inner shell. As a consequence of this procedure and apparatus, the inner shell is aligned in an adjusted position substantially coaxial with the rotor axis. A slight offset of the inner shell relative to the rotor axis may be provided to accommodate for rotor bowing.

In a preferred embodiment according to the present invention, there is provided in a turbine having arcuate inner and outer shells and a rotor within said outer and inner shells having an axis, a method for aligning the inner and outer shells relative to one another, comprising the steps of (a) supporting an alignment fixture from the outer shell, (b) supporting the inner shell within the outer shell by the alignment fixture and (c) adjusting the inner shell relative to the outer shell by adjusting the alignment fixture relative to the outer shell.

In a further preferred embodiment according to the present invention, there is provided a method of disassembling a turbine having inner and outer shells with the inner shell supported by and within said outer shell, the shells being concentric about a rotor within the inner shell and having an axis comprising the steps of (a) attaching a fixture to the outer shell, (b) supporting the fixture from the outer shell and (c) transferring support of the inner shell by the outer shell to the fixture.

In a still further preferred embodiment according to the present invention, there is provided a method of disassembling a turbine having a pair of arcuate upper and lower outer shell sections and a pair of arcuate upper and lower inner shell sections concentric about a rotor having an axis and without removing the rotor from the turbine, comprising the steps of (a) removing the upper outer shell section, (b) removing the upper inner shell section, (c) supporting a fixture from the lower outer shell section, (d) transferring support of the lower inner shell section from the lower outer shell section to the fixture, (e) subsequent to step (c), securing roller assemblies to the lower outer shell section for engaging the lower inner shell section, (f) transferring support for the lower inner shell section from the fixture to the roller assemblies and the lower outer shell section, (g) rotating the lower inner shell section about the axis to a location above the lower outer shell section and (h) subsequent to step (g), removing the lower inner shell section.

In a still further preferred embodiment according to the present invention, there is provided a method of assembling a turbine having a pair of upper and lower outer shell sections and a pair of upper and lower outer shell sections about a rotor comprising the steps of (a) attaching a fixture to the lower outer shell section, (b) supporting the fixture from the lower outer shell section, (c) inserting the lower inner shell section into the lower outer shell section, (d) supporting the lower inner shell section from the lower outer shell section, (e) disposing the rotor in the lower inner shell section, (f) securing the upper inner shell section to the lower inner shell section and (g) transferring support from the upper and lower inner shell sections from the fixture to elements interconnecting the inner shell sections and the outer shell sections.

In a still further preferred embodiment according to the present invention, there is provided an alignment fixture for securement to an outer shell of a turbine having inner and outer shells secured to one another about a rotor having an axis, comprising a pair of mounts for securement to the outer shell, a frame having support members movable thereon between (i) a support position passing through access openings of the outer shell and in engagement with the inner shell to support the inner shell from the frame and (ii) a non-support position spaced from the inner shell and at least one adjustable element interconnecting the frame and at least one of the mounts for adjusting the position of the frame relative to the outer shell in one of an axial direction or in a plane normal to the axis of the rotor, when the support members lie in the support position, thereby adjusting the inner shell relative to the outer shell.

DETAILED DESCRIPTION OF THE INVENTION

Figure 1:
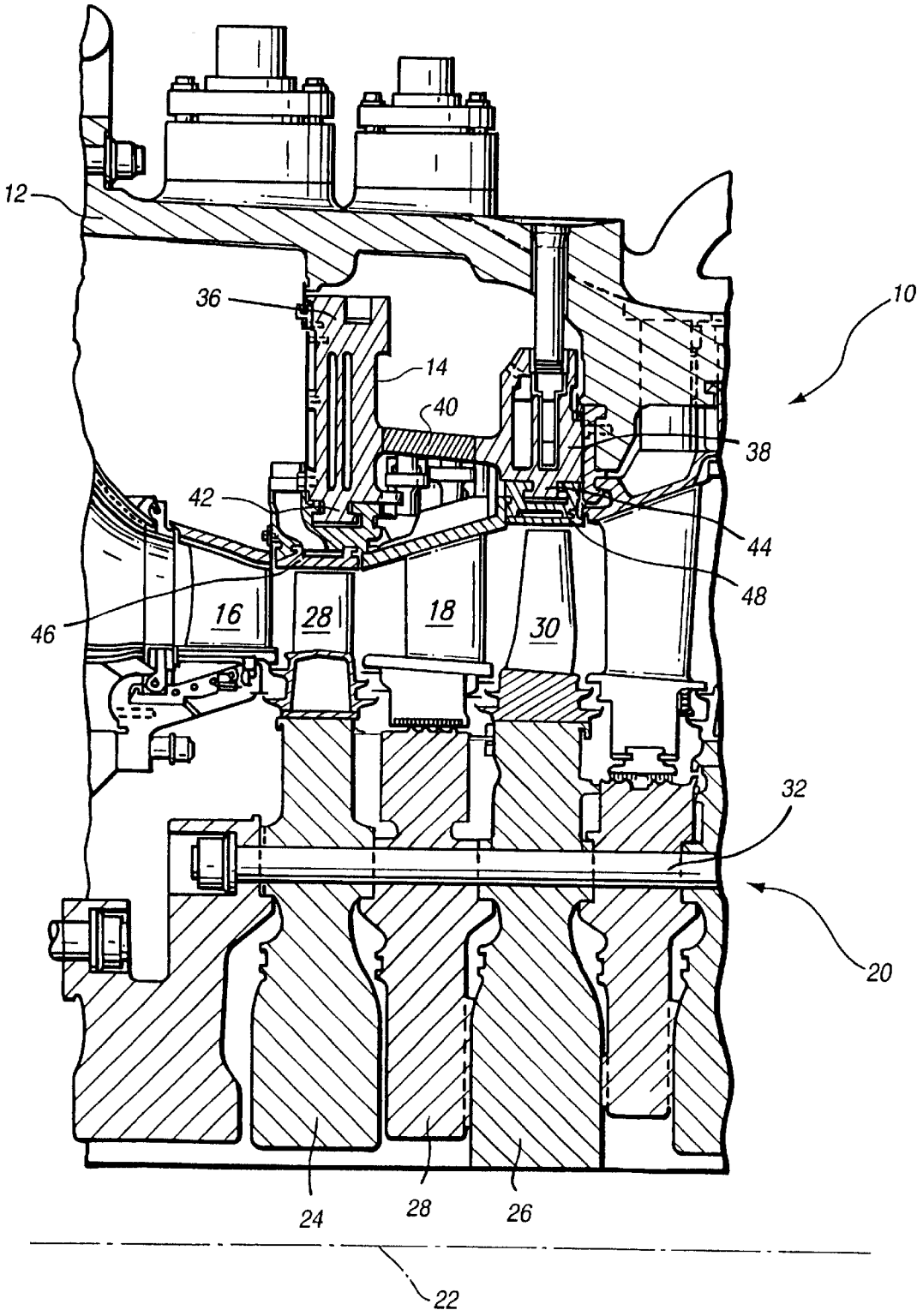
FIG. 1 is a fragmentary cross-sectional view of first and second stages of a turbine incorporating an inner and outer shell construction.

Referring to FIG. 1, there is illustrated a turbine section, generally designated 10, of a turbine having an outer structural shell 12 and an inner shell 14 supported by the outer shell 12. The inner shell 14 carries an array of nozzles 16 and 18 forming parts of first and second stages, respectively, of the turbine. The inner shell 14 also surrounds a rotor, generally designated 20, rotatable about an axis 22. The rotor 20 includes circumferential arrays of buckets mounted on wheels arranged alternately with spacers, the wheels and spacers forming the body of the rotor. For example, the first and second-stage wheels 24 and 26 with an intervening spacer 28 are illustrated, the wheels 24 and 26 mounting buckets 28 and 30, respectively. It will be appreciated that the buckets and the nozzles of the various stages in part define an annular hot gas path through the turbine. As conventional, the wheels and spacers of the rotor are secured to one another by axial extending bolts 32 circumferentially spaced one from the other about the rotor.

Figure 2:
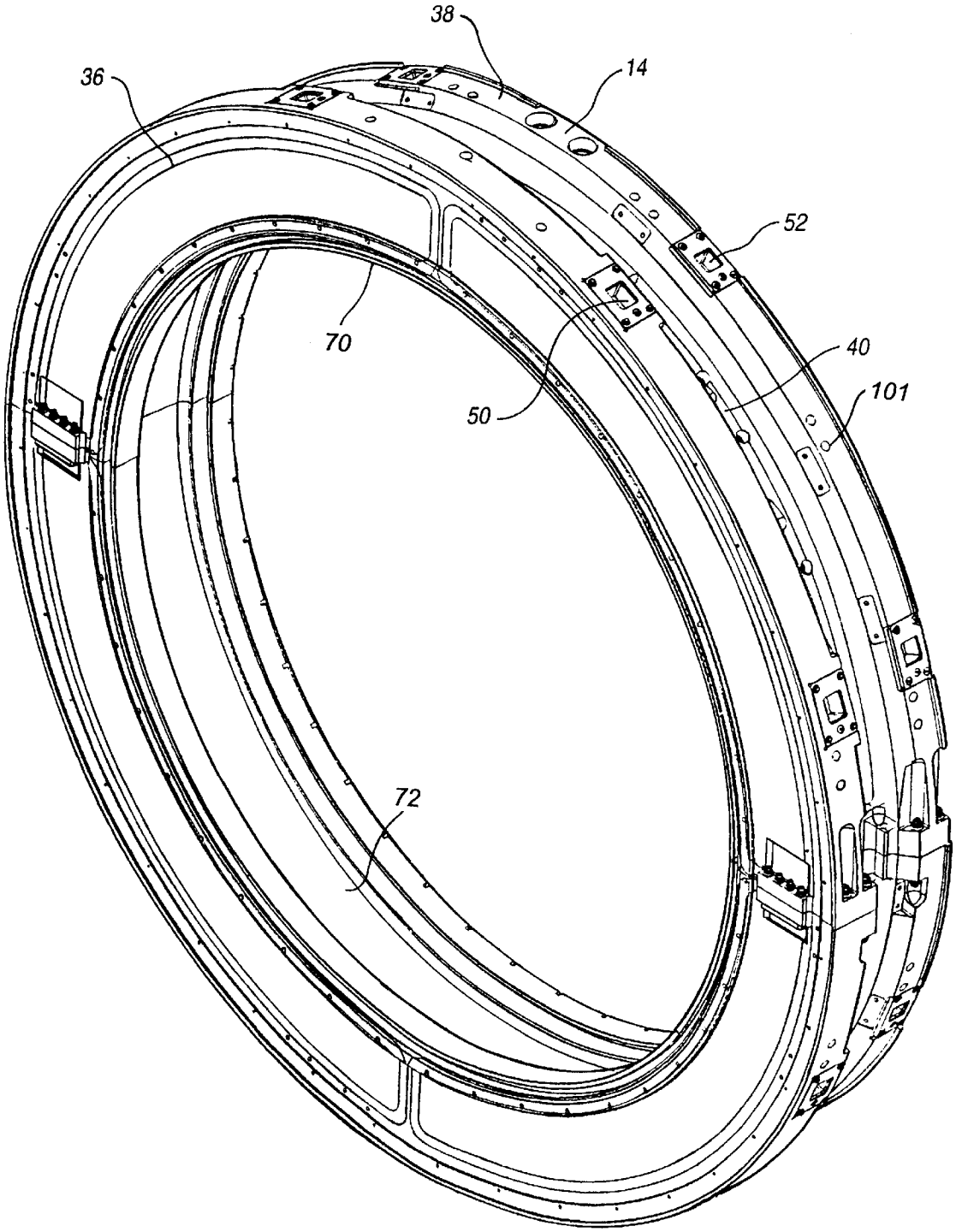
FIG. 2 is a perspective view of an inner shell with the nozzles and shrouds not shown for clarity.

Referring to FIGS. 1 and 2, the inner shell 14 comprises a forward portion 36 and an aft portion 38 interconnected by an axially extending annular rib 40. The forward and aft portions 36 and 38 are annular and have radially inwardly directed dovetails 42 and 44, respectively, for carrying shrouds 46 and 48. The shrouds provide a minimum clearance with the tips of the buckets. It will be appreciated that the inner shell 14 is secured to the outer shell along radial planes normal to the axis of the rotor and at axial locations, preferably in alignment with the first and second-stage buckets and shrouds.

Figure 3:
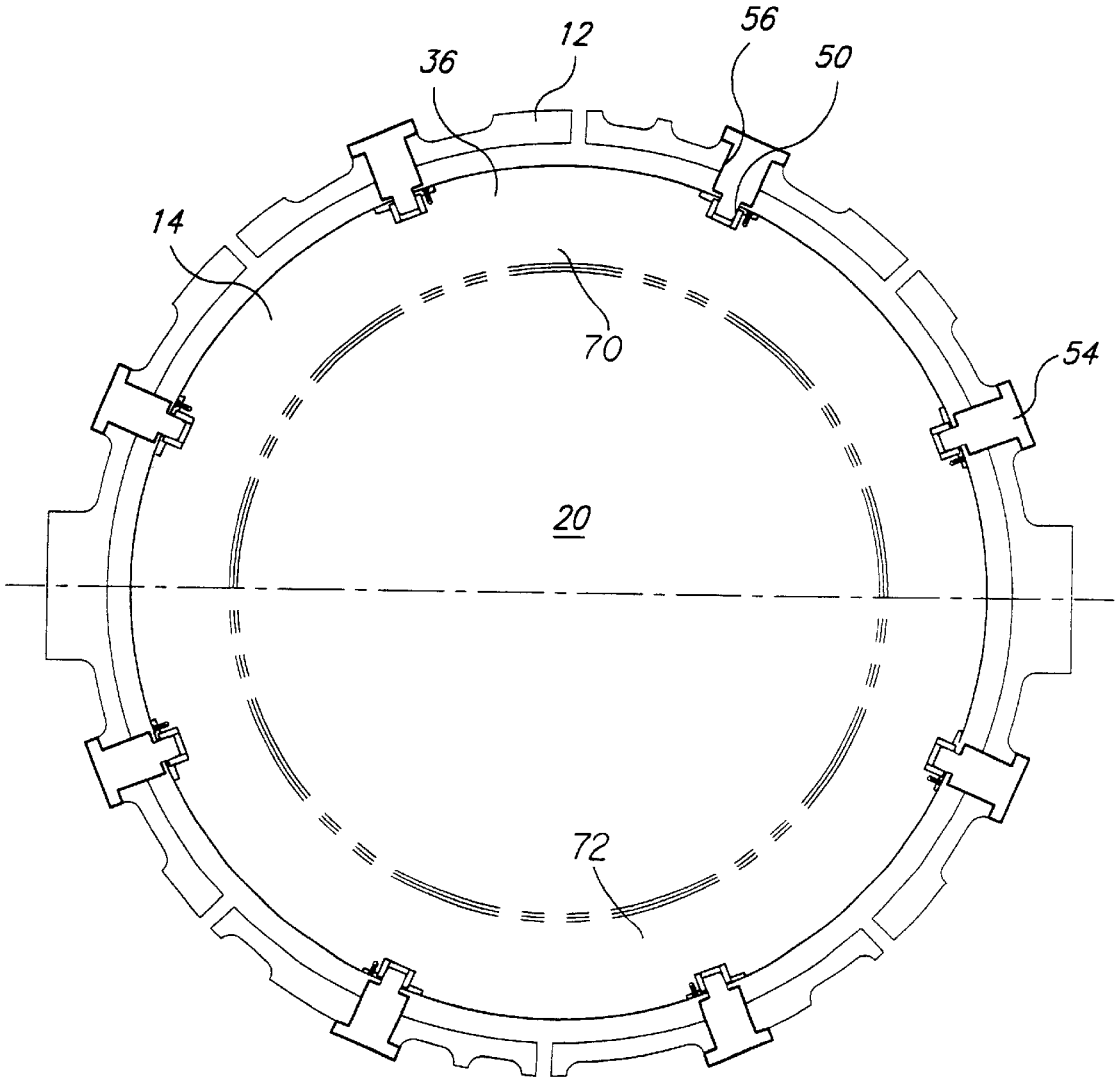
FIG. 3 is an axial schematic end view illustrating a preferred pinned connection between the inner and outer shells.

To connect the inner and outer shells to one another, each of the forward and aft portions 36 and 38, respectively, of the inner shell 14 are provided with circumferentially spaced recesses 50 and 52. As illustrated in FIG. 3, connecting elements, e.g., support pins 54 pass through access openings 56 through the outer shell for connection with the forward portion 36 of inner shell 14. Similar pins interconnect the outer shell 12 with the aft portion 38 of inner shell 14. Preferably, the pins lie at eight pin locations in each radial plane and are spaced approximately 45° one from the other about the rotor axis, although it will be appreciated that a greater or fewer number of support pins at different circumferential locations may be used. The support pins 54 are also spaced from the horizontal splitline of the inner shell. The support pins include an enlarged head having a bolt circle with a plurality of bolt openings, a cylindrical shank and end projections. The precise geometry of the support pins is not relevant to the present invention, it being suffice to say that the support pins support the inner shell from the outer shell for radial and axial expansion and contraction, with the pins carrying only circumferential loadings.

Figure 6:
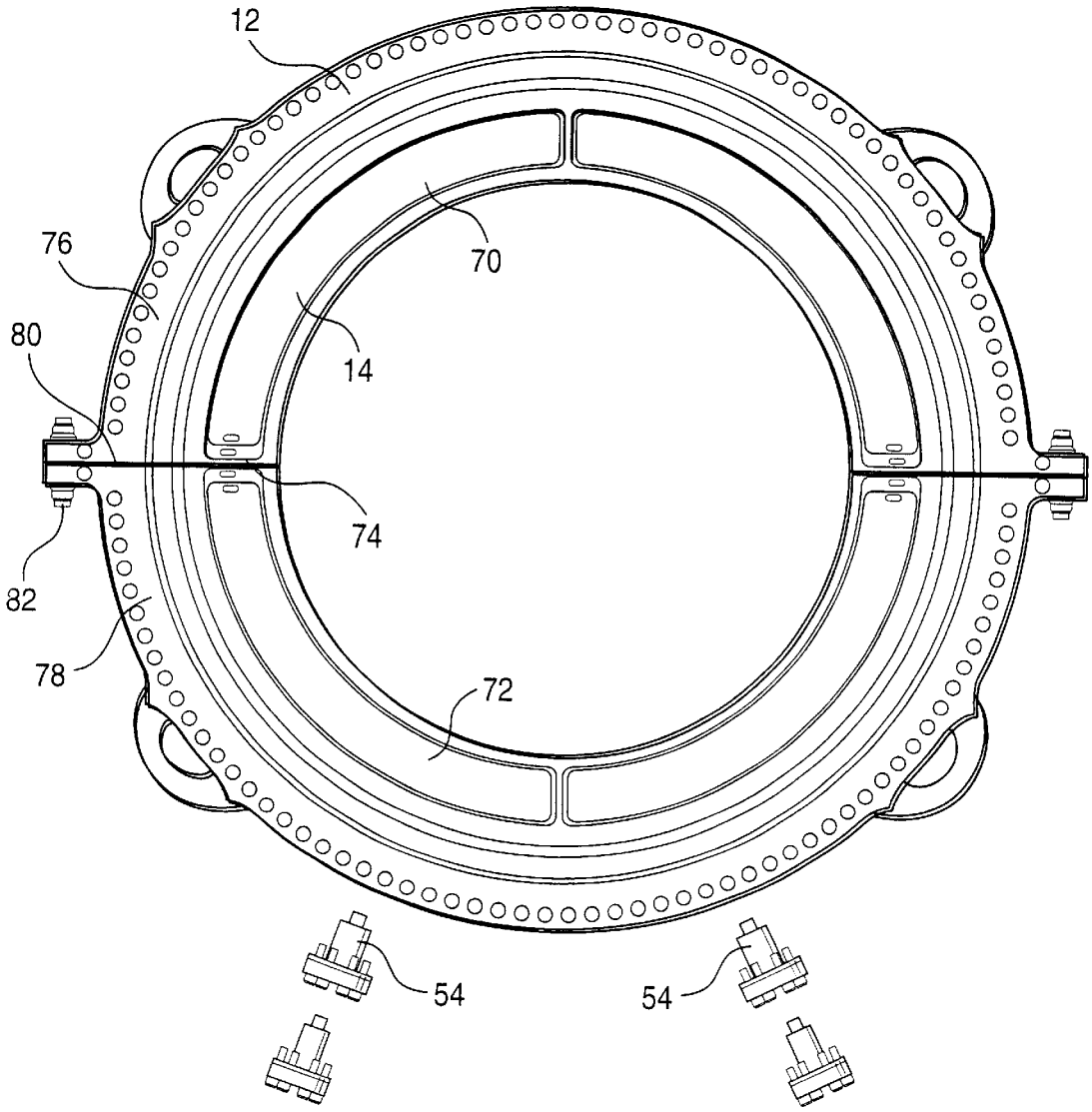
FIGS. 6–14 are schematic axial elevational views illustrating the field disassembly of the upper outer shell section and the inner shell sections from the turbine with the rotor disposed within the turbine.

Referring to FIG. 6, each of the inner and outer shells 14 and 12, respectively, are preferably formed of semi-cylindrical shell sections or halves extending 180°. For clarity, the nozzles and shrouds carried by the inner shell sections are not shown in these drawing figures except for FIG. 1. Thus, the inner shell 14 comprises, as illustrated in FIG. 6, an upper inner shell section 70 and a lower inner shell section 72 joined together along a horizontal splitline, generally designated 74. Similarly, the outer shell 12 includes an upper outer shell section 76 and a lower outer shell section 78 joined along a horizontal splitline 80. As noted above with respect to FIG. 3, the support pins 54 secured to and extending through the outer shell sections engage in recesses or sockets 50 and 52 in the inner shell sections in fore and aft portions 36 and 38 to maintain the inner shell concentric about the rotor axis.

Figure 4:
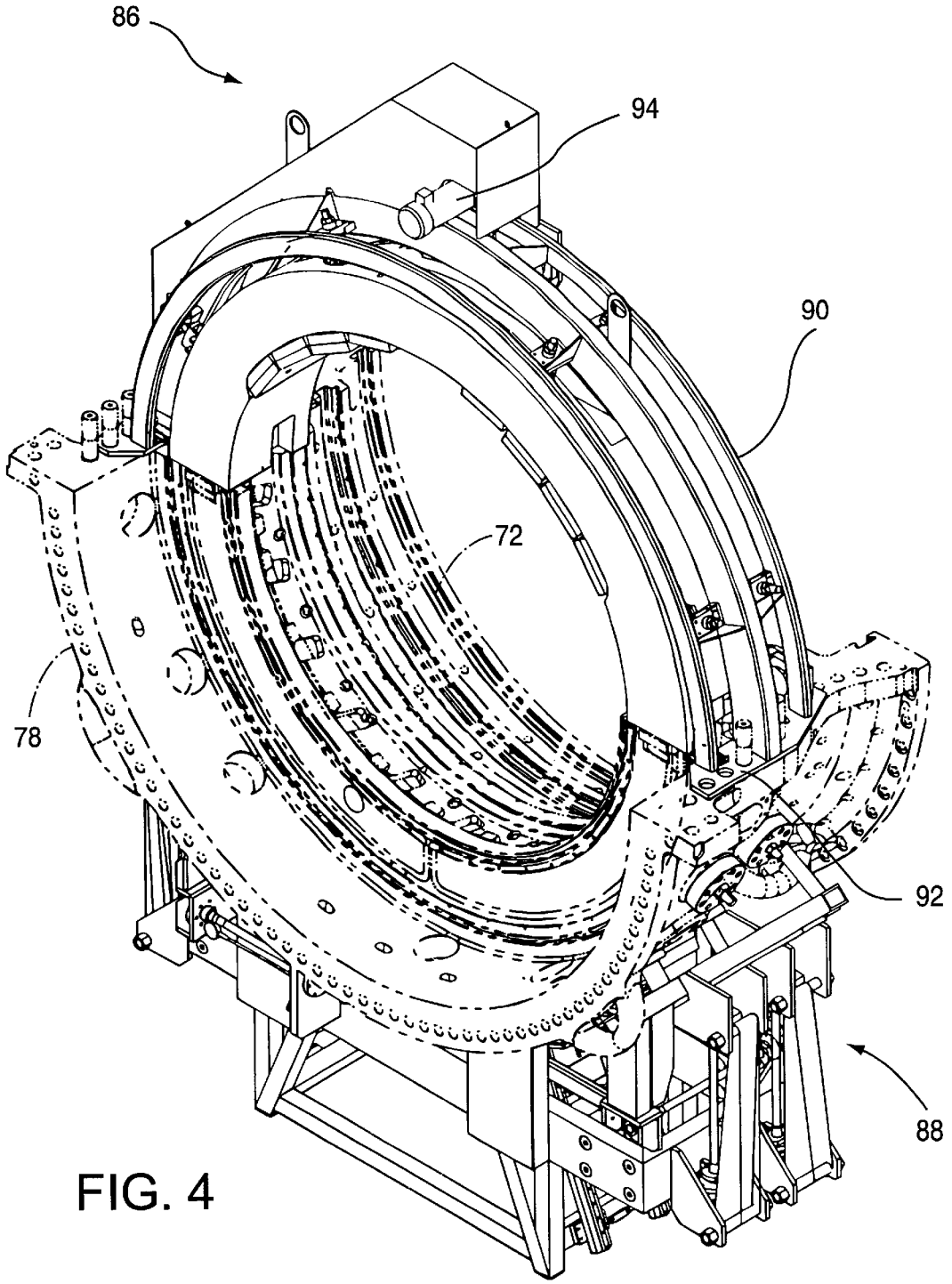
FIG. 4 is a perspective view of a roller cage assembly and alignment fixture for installing and aligning, respectively, the inner shell within the outer shell and concentric about the axis of the turbine rotor.

FIG. 4 illustrates in perspective the lower outer shell section 78 about the lower inner shell section 72, the upper inner and outer shell sections 70 and 76, respectively, having been removed. Illustrated in FIG. 4 is a roller cage assembly, generally designated 86, and an alignment fixture, generally designated 88. As best illustrated, referring to FIGS. 4 and 14, the roller cage 86 includes a plurality of semi-circular frame members 90 terminating at opposite ends in plates 92 for securement to opposite ends of the lower outer shell section 78. The roller cage assembly 86 includes a motor 94 which drives an endless chain 96 (FIG. 14) about a sprocket within the motor housing and about a sprocket 98 adjacent one end of the cage. A bracket 99 (FIGS. 13 and 14) has bolt holes for receiving bolts to secure the bracket to bolt holes 101 (FIG. 2) formed along the fore and aft rims of the inner shell and along a dummy shell. The bracket 99 is also secured to the chain 96 whereby upon operation of the motor, the bracket 99 moves with the chain 96. When the bracket is secured to the inner shell section or the dummy shell section, the shell sections rotate as described hereinafter.

Figure 5:
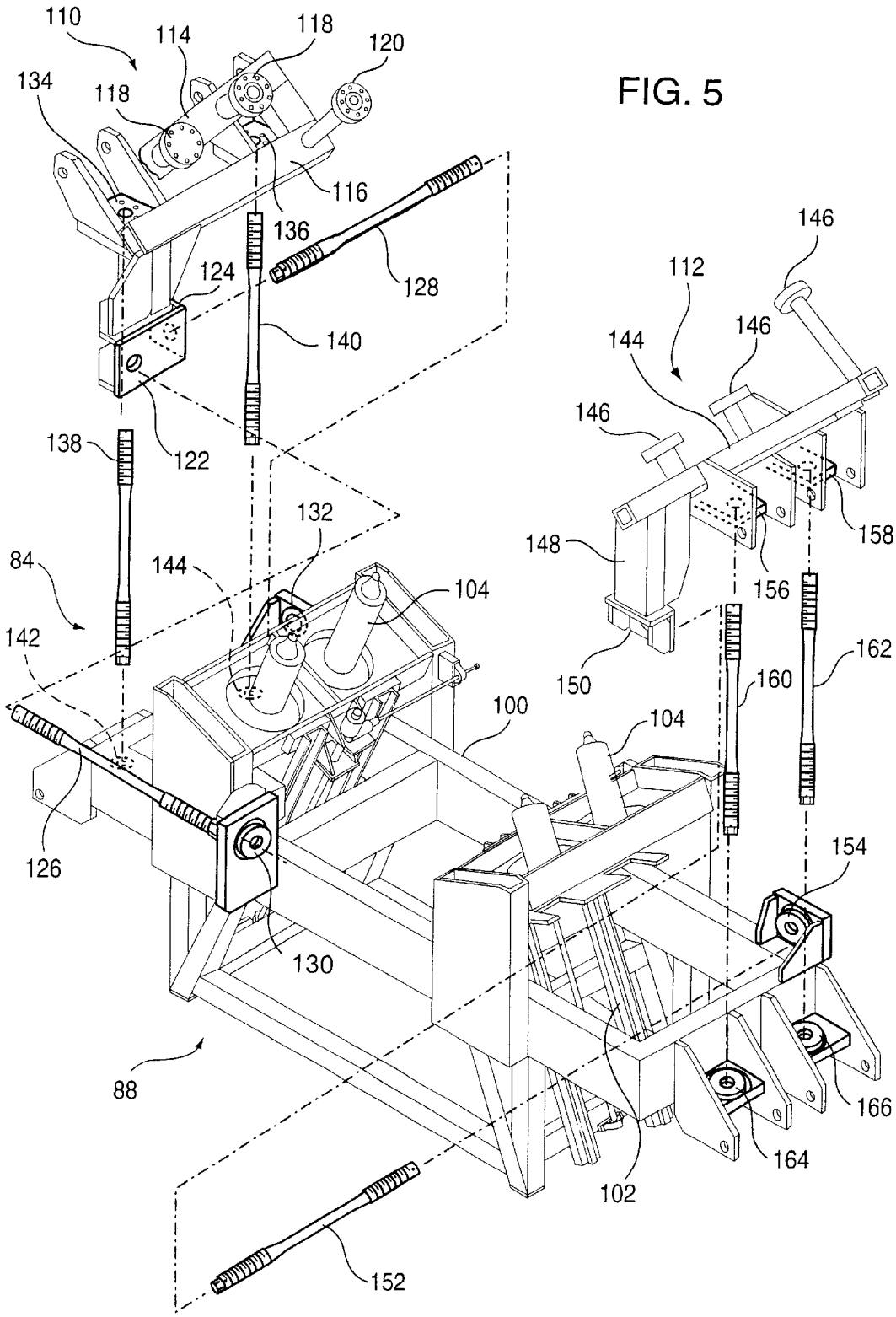
FIG. 5 is a perspective view of the alignment fixture in part broken away for ease of illustration.

Referring now to FIG. 5, the alignment fixture 88 includes a generally rectangular frame 100. The alignment frame 100 includes on opposite sides of a centerline parallel to the rotor axis pairs of inclined tracks 102. Motors, not shown, drive pairs of support members, e.g., cradle pins 104, along tracks 102. The tracks 102 and cradle pins 104 carried for movement therealong are substantially aligned with the support pin openings through the outer shell at the 5 and 7 o'clock positions and are sized and configured to pass through the support pin openings to engage in the recesses 50 and 52 of the lower inner shell section 72 when the support pins are removed from those openings. Thus, with the support pins at the 5 and 7 o'clock positions removed, the cradle pins 104 may pass through the support pin openings and engage in the recesses 50 and 52 of the inner shell.

The alignment fixture 88 also includes left and right-hand mounts, generally designated 110 and 112, respectively, for securing the alignment fixture directly to the lower outer shell section 78 whereby the alignment fixture is suspended from the lower outer shell section without additional support. The left-hand mount 110 includes a pair of structural members 114 and 116 interconnected together. Member 114 supports a pair of structural bolt circle flanges 118, while member 116 supports a bolt circle flange 120. The bolt circles flanges 118 and 120 connect with corresponding bolt circle flanges on the outer surface of the lower outer shell section 78. Thus, in use, the left-hand mount 110 is structurally connected to the lower outer shell half. Mount 110 also includes a depending structural bracket formed of right angularly related plates 122 and 124 having openings for receiving the ends of adjusting rods 126 and 128, respectively. As discussed hereinafter, the adjusting rods 126 and 128 extend in lateral and axial directions, respectively, normal to one another. The opposite ends of the rods 126 and 128 reside in ball joints 130 and 132, respectively, formed on structural members connected to the frame 100.

Additionally, the structural members 114 and 116 are structurally secured to axially spaced horizontal plates 134 and 136. The upper ends of vertical adjusting rods 138 and 140 are secured to the plates 134 and 136, respectively. The lower ends of the rods are secured in ball joints 142 and 144, secured in structural portions of the frame 100.

The right-hand mount 112 includes a generally triangular arrangement of structural members, designated 144, mounting a plurality of structural elements terminating in bolt circle flanges 146. These bolt circle flanges are secured by suitable bolts to corresponding bolt circle flanges along the outside surface of the lower outer shell section 78, thereby structurally securing the right-hand mount 112 to the outer shell. Depending from the mount 112 by a structural element 148 is an axially facing plate 150 which receives one end of an adjusting rod 152. The adjusting rod lies substantially parallel to the axis of the rotor and its opposite end is received in a ball joint 154 secured to the frame 100. Further, the right mount 112 includes a pair of plates 156 and 158 to which the upper ends of a pair of vertical adjusting rods 160 and 162 are secured. The lower ends of the rods 160 and 162 are secured in ball joints 164 and 166, respectively, secured to the end of the frame. The ends of the adjusting rods have flats to which tools, e.g., socket wrenches, may be applied for rotating and hence screwthreading the adjusting rods relative to their mounts to adjust the inner shell relative to the outer shell, as will become clear from the ensuing description.

As will be appreciated from the foregoing, the left and right-hand mounts 110 and 112, respectively, are structurally supported from the lower outer shell section 78. The mounts, in turn, support the frame 100, including the cradle pins 104, solely by the four vertically extending adjusting rods 138, 140, 160 and 162. At various stages of the disassembly and assembly procedures, as will become clear, the weight of the inner shell is supported from the outer shell through the left and right-hand mounts, the four vertical adjusting rods, the frame 100 and the cradle pins 104. It will also be appreciated that when the inner shell is supported by the cradle pins, movement of the frame 100 by adjustment of the adjusting rods effects movement of the inner shell relative to the outer shell vertically, axially, transversely and with variable adjustment of the vertical adjusting rods in a tilt direction.

Figure 7:
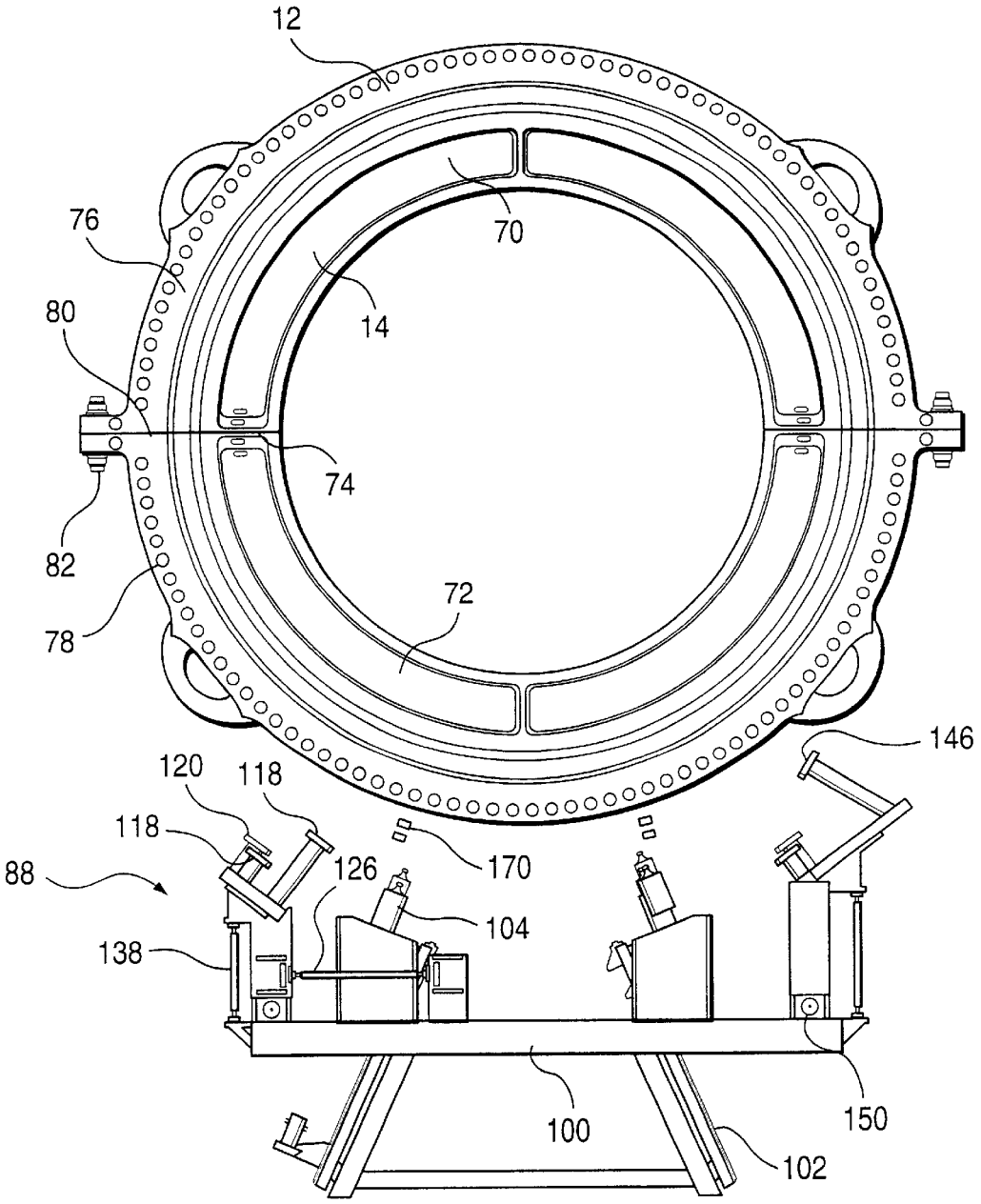
Figure 8:
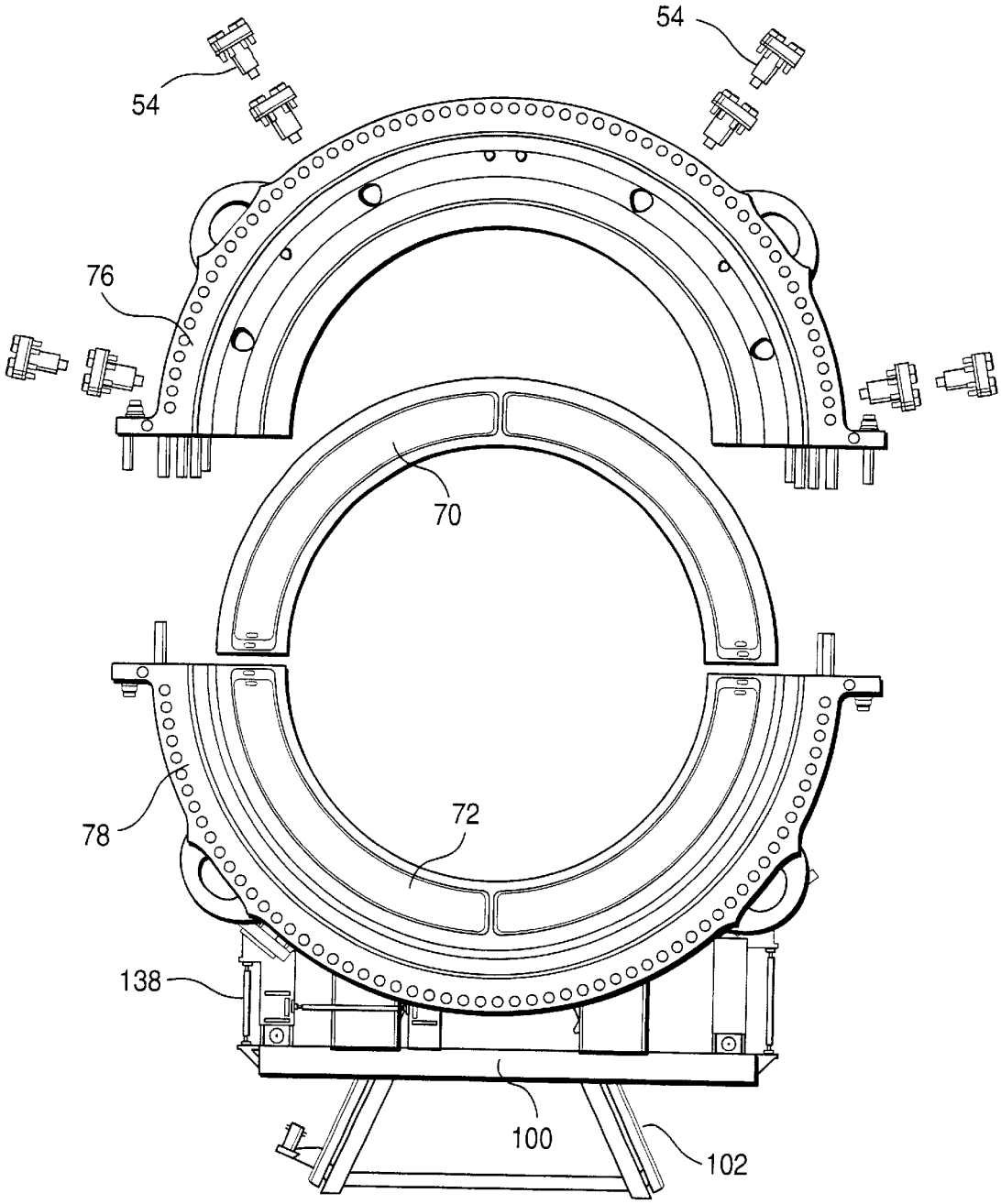

Referring now to FIGS. 6–14, a field disassembly procedure using the roll cage assembly and alignment fixture will now be described. Initially, it will be appreciated that the turbine is supported in bearing blocks and that the illustrated inner and outer shells are elevated above any support. With the rotor 20 within the inner shell, the fore and aft support pins 54 at the 5 and 7 o'clock positions are removed from the outer shell, as illustrated in FIG. 6. The alignment fixture 88 is then secured to the lower outer shell section 78 as shown in FIG. 7. Particularly, the bolt circle flanges of the left and right mounts 110 and 112 are secured to corresponding flanges by bolts, not shown, whereby the alignment fixture 88 is suspended from the outer shell 12. Cradle inserts 170 are installed in the recesses 50 and 52 of the lower inner shell section 72 for receiving the cradle pins 104. The cradle pins 104 are then inserted through the openings in the lower outer shell section 78 vacated by the support pins 54 and into engagement with the recesses 50 and 52 of the inner shell at corresponding locations by advancing the pins 104 along the tracks 102. With the alignment fixture 88 suspended from the lower outer shell section 78, the support pins between the upper outer shell section 76 and the upper inner shell section 70 at both forward and aft portions of the inner shell are removed (see FIG. 8). The upper outer shell section 76 is then disconnected from the lower outer shell section 78 at the horizontal splitline by removing the bolts connecting the shell sections to one another. The outer shell section 76 is then removed by lifting it vertically from the lower outer shell section 78. The upper inner shell section 70 is similarly removed from the turbine upon removal of the bolts securing it to the lower inner shell section 72 at the horizontal splitline. The depending nozzles and shrouds, as well as ancillary structure are removed with the upper inner shell section 70.

Figure 9:
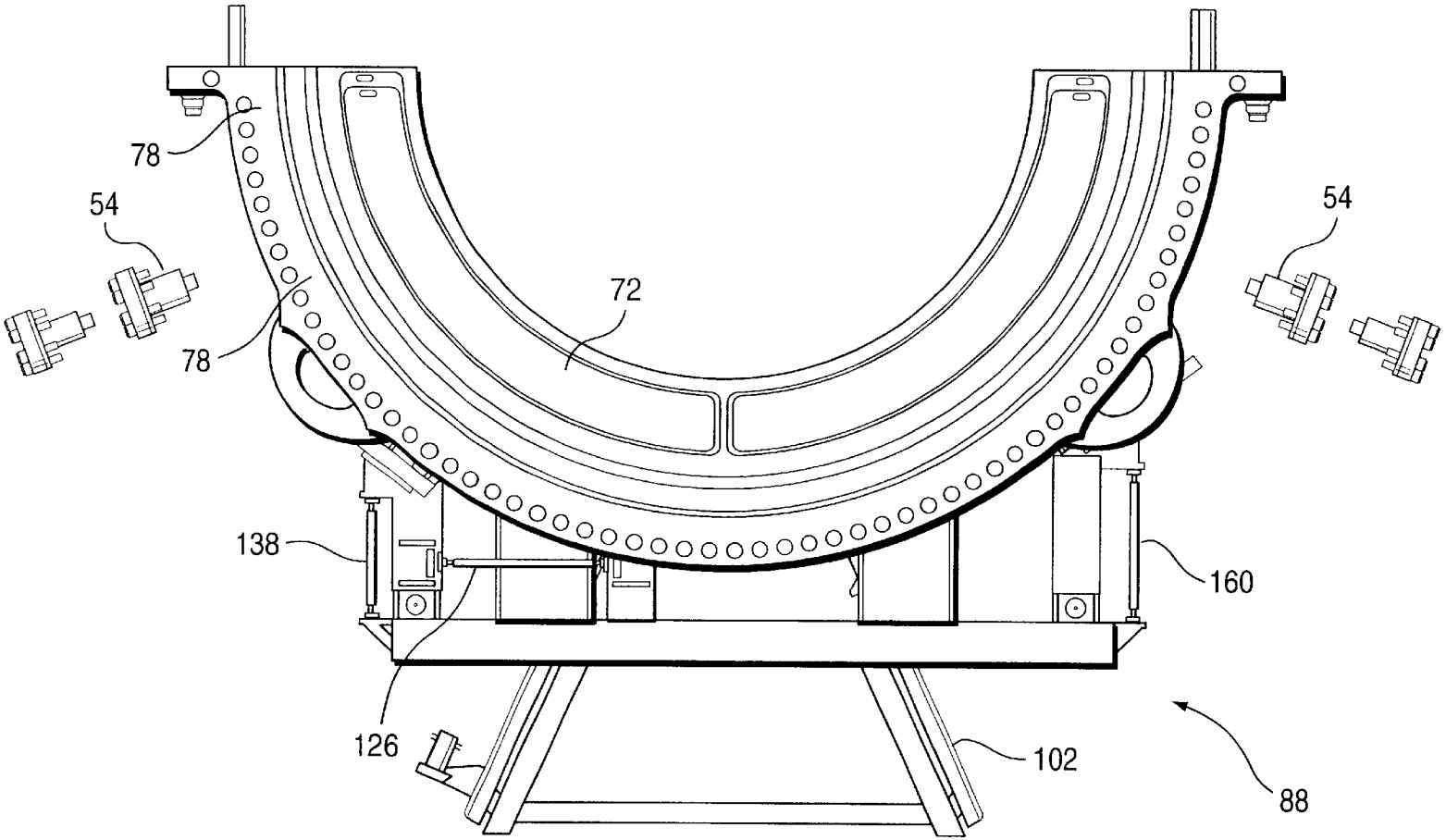

With both the upper, outer and inner shell sections removed, the remaining four support pins 54 at the 8 o'clock and 4 o'clock positions interconnecting the lower outer shell section 78 and the lower inner shell section 72 to one another are removed, as illustrated in FIG. 9. Because the rotor remains in the turbine, it will be appreciated that the lower inner shell section 72 cannot be directly removed by lifting it from the lower outer shell section 78. To remove the lower inner shell section 72, it is displaced slightly forwardly to obtain additional axial clearance, using the alignment fixture 88. To accomplish this, the adjusting rods 152 and 128 are rotated to displace the frame 100 relative to the left and right-hand mounts 110 and 112, respectively. It will be recalled that the left and right mounts 110 and 112, respectively, are rigidly and structurally secured to the lower outer shell section 75. By rotating adjusting rods 152 and 128, it will be appreciated that the frame 100 is displaced in an axial direction relative to the mounts 110 and 112. With the cradle pins 104 carried by frame 100 engaging in the recesses 50 and 52 of the lower inner shell section 72, the latter is likewise displaced relative to the lower outer shell section 78 in an axial direction.

Figure 10:
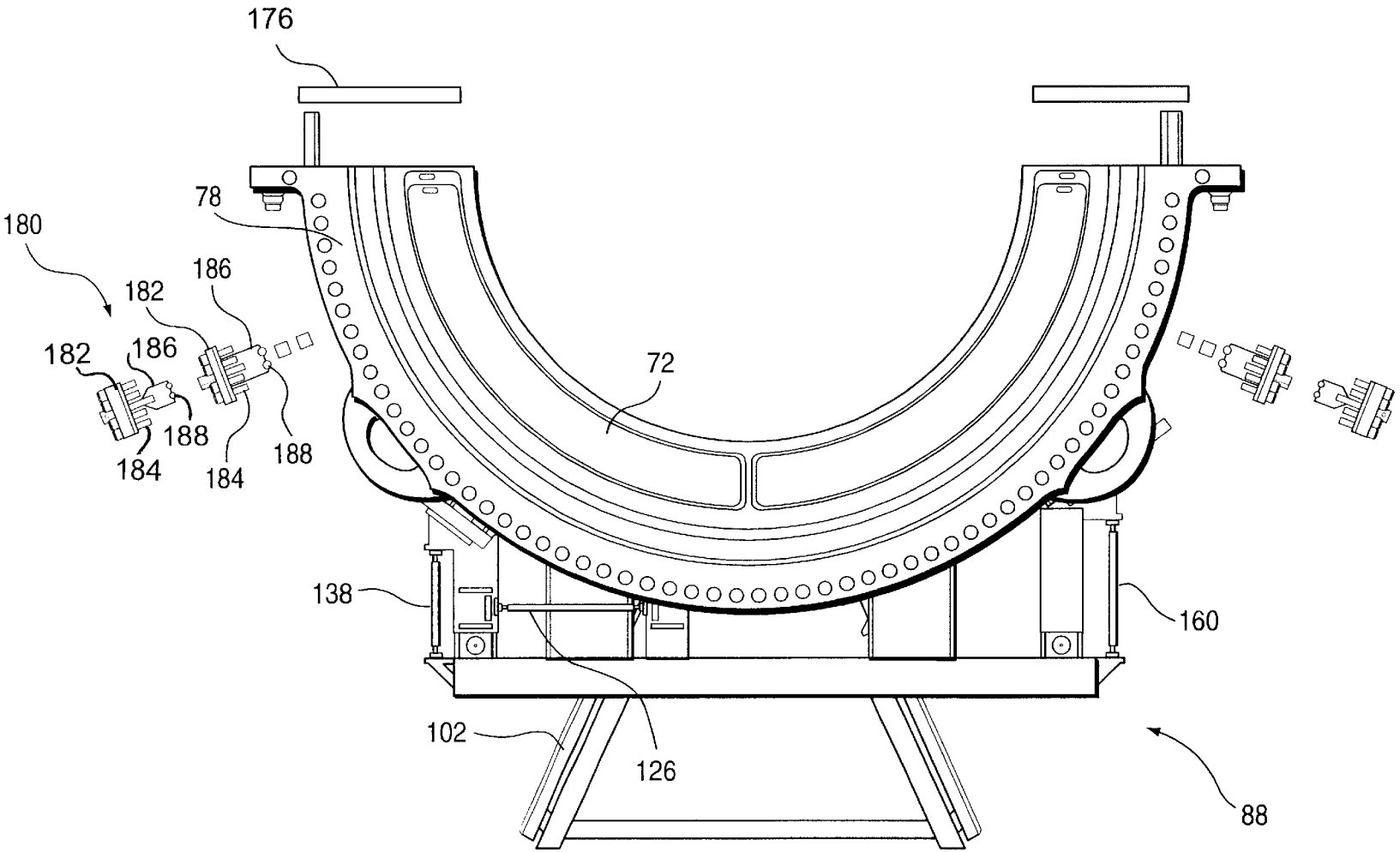

After this axial movement of the lower inner shell section, splitline support plates 176 are attached to the outer shell section 78 as illustrated in FIG. 10. These plates 176 overlie the ends of the lower inner shell section 72 to prevent rotation of the lower inner shell section 72 relative to the lower outer shell section 78.

Roller assemblies, generally designated 180, are then installed through the vacated support pin access openings in the lower outer shell section 78 at the 4 and 8 o'clock positions. The rollers 188 of the roller assemblies 180 engage the rims of the forward and aft portions of the lower inner shell section. Each roller assembly includes a bolt circle 182 for receiving bolts 184 whereby the roller assembly can be secured to the bolt circles flanges of the lower outer shell section. The roller assemblies 180 also include a truck 186 mounting pairs of rollers 188 for engagement along the lower inner shell section rims.

Figure 11:
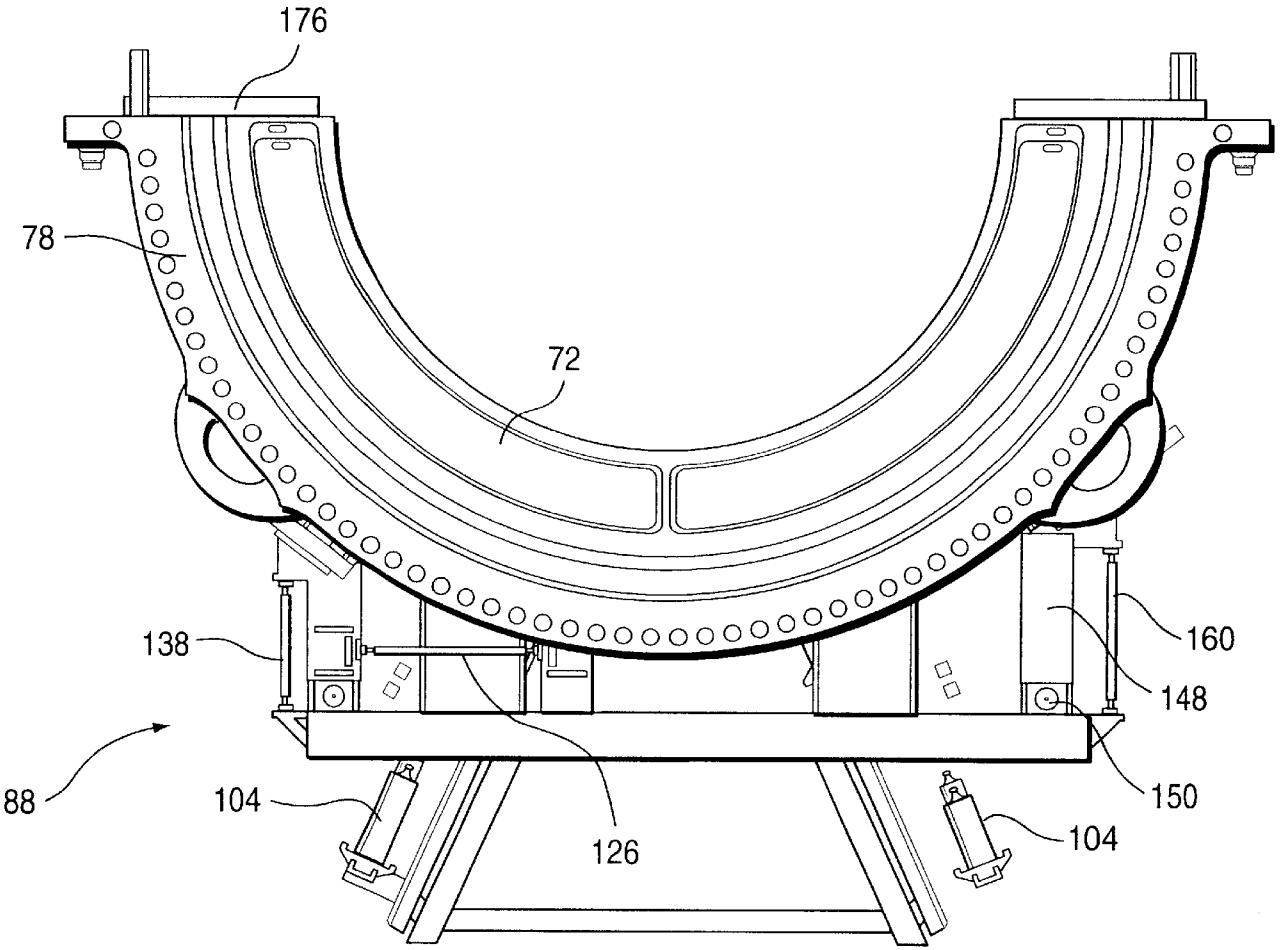
Figure 12:
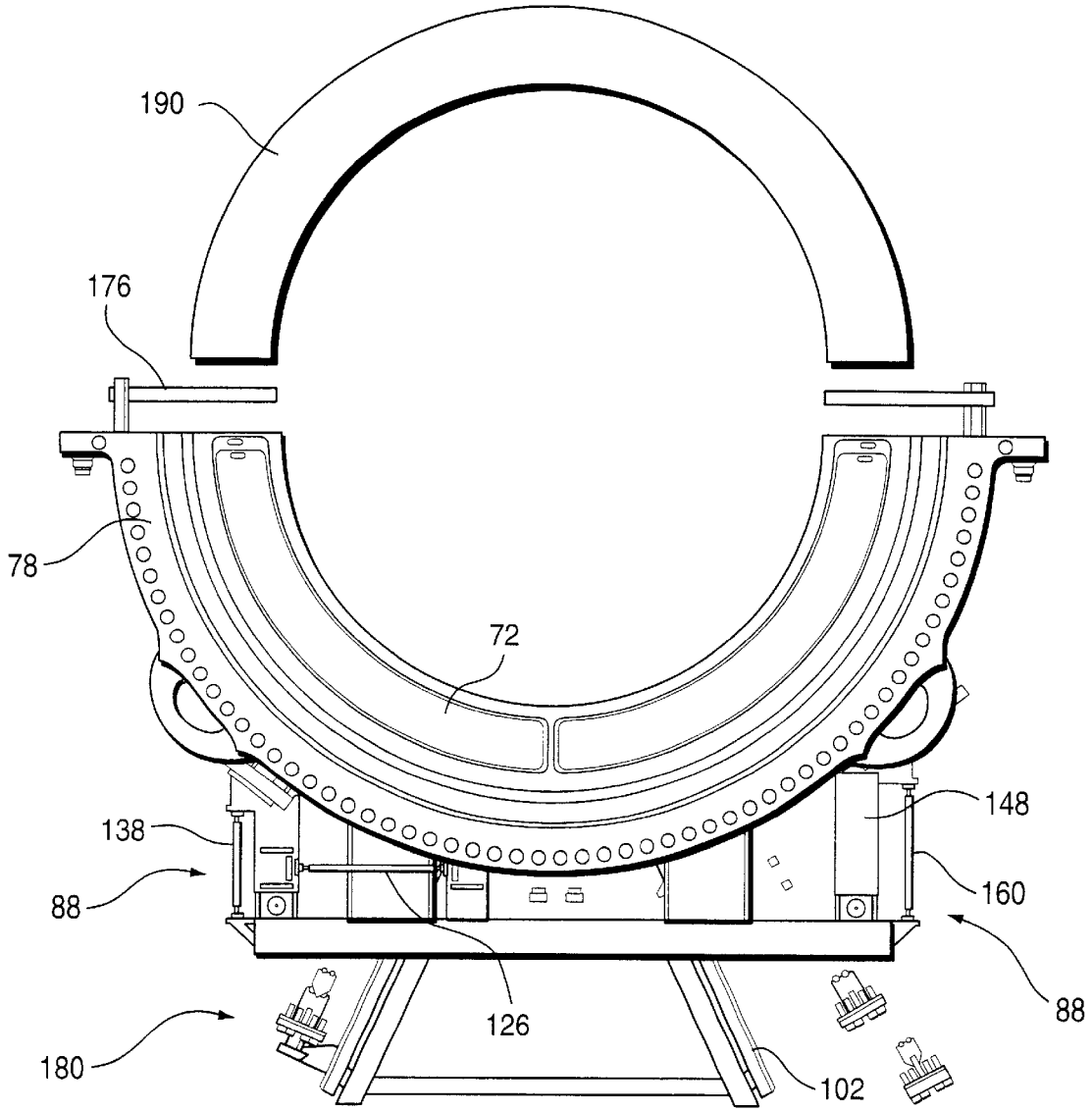

Referring to FIG. 11, the cradle pins 104 are next retracted along their respective tracks and the cradle pin inserts are removed. As a consequence, the weight of the lower inner shell section is borne by the roller assemblies 180 at the 8 and 4 o'clock positions. Referring to FIG. 12, additional roller assemblies 180 are then disposed on the tracks 102 formerly holding the cradle pins 104 and are advanced into the access openings through the lower outer shell section 78 at the 5 and 7 o'clock positions to engage the rims of the inner shell, the roller assemblies 180 being secured to the lower outer shell section 78. It will be appreciated that the motorized track 102 of the alignment fixture 88 can be used to insert the roller assemblies 180 in view of the weight of the roller assemblies, i.e., approximately 175 pounds each. With the pairs of roller assemblies respectively engaging fore and aft rim portions of the inner shell at the 4, 5, 7 and 8 o'clock positions, it will be appreciated that the lower inner shell section is supported by the lower outer shell section 78 on the roller assemblies 180.

Figure 13:
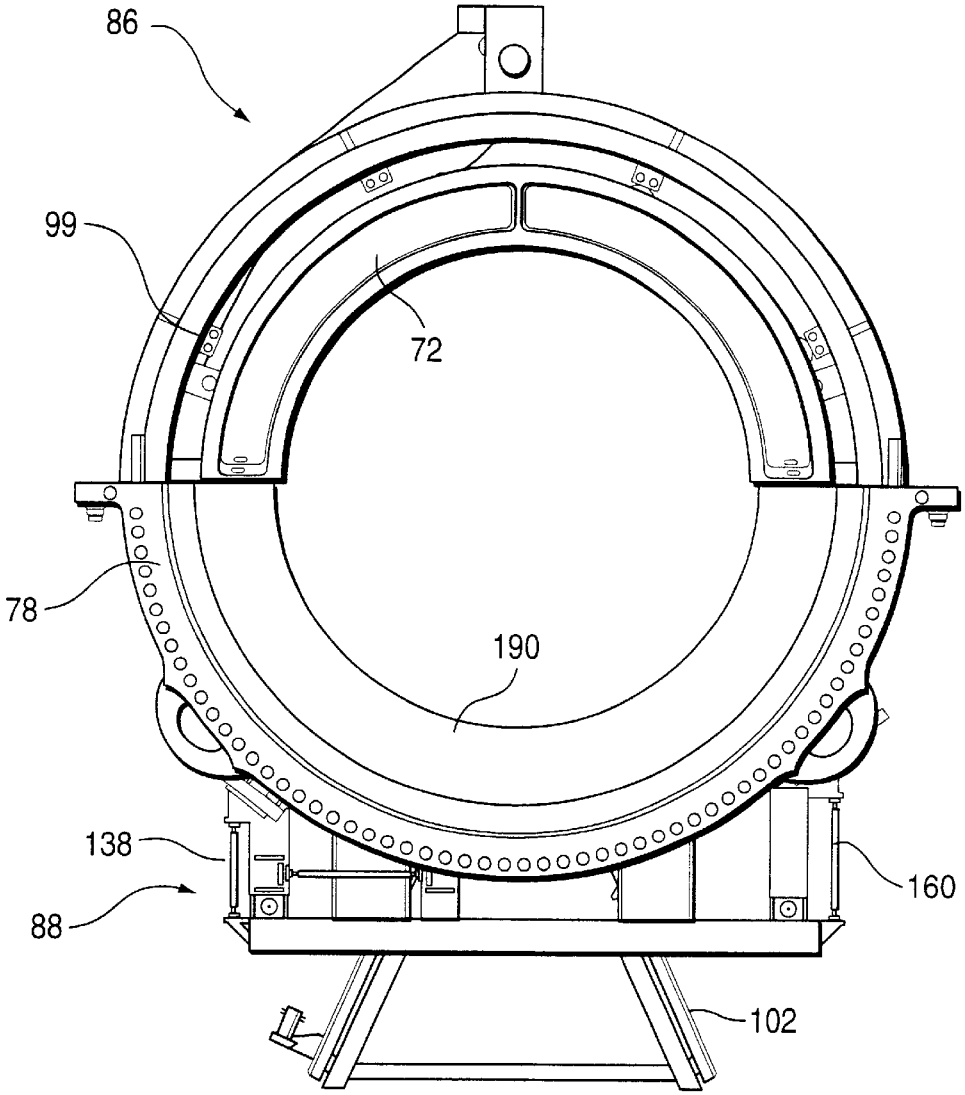
Figure 14:
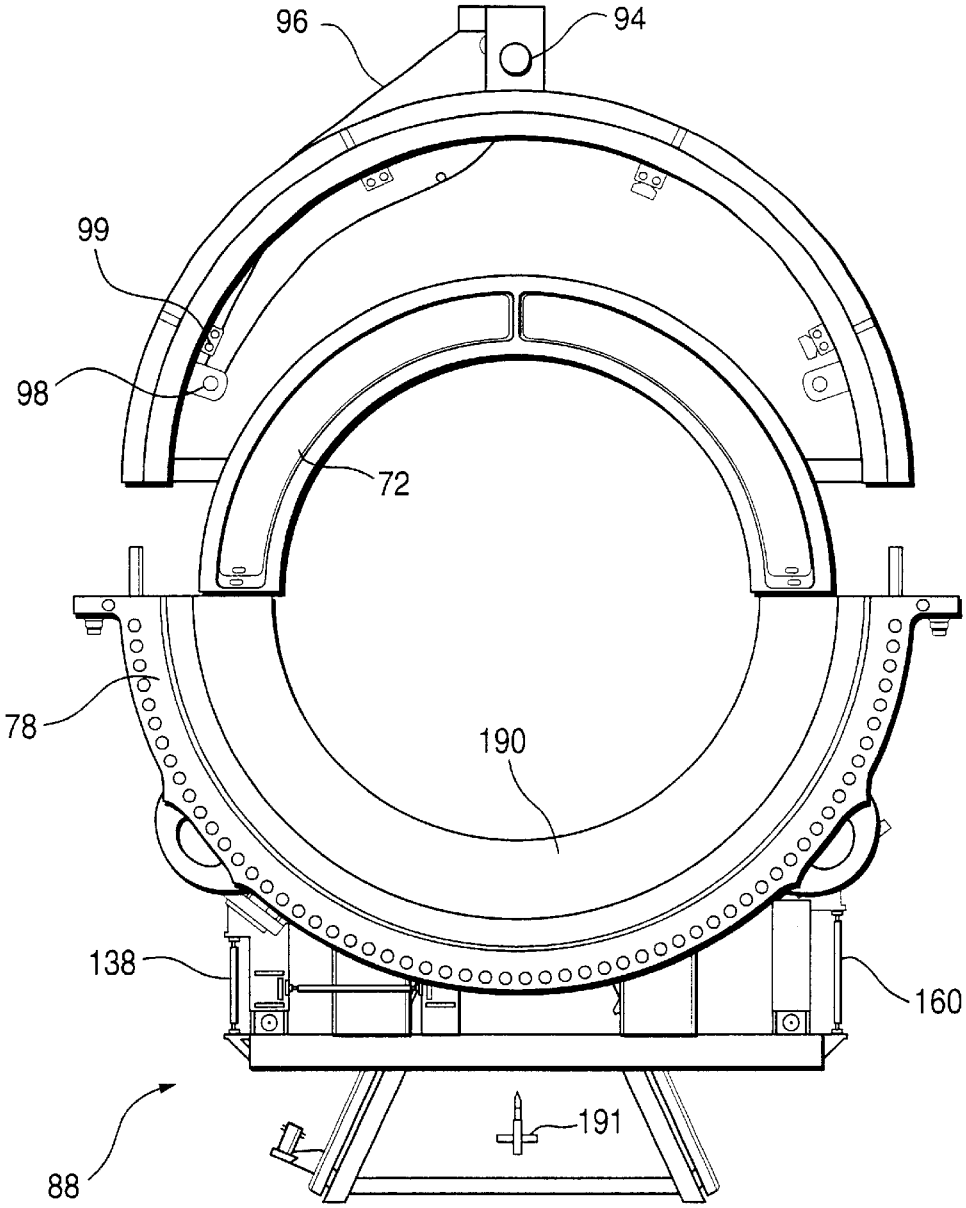

As illustrated in FIG. 12, the splitline support plates 176 are then removed and a dummy inner shell 190 is secured to the lower inner shell section 72 at its horizontal splitline. The dummy shell section 190 is comparable in weight to the lower inner shell section 72. Next, as illustrated in FIG. 13, the roll cage assembly 86 is installed. Particularly, the roll cage assembly straddles the dummy inner shell section 190 and is attached to the lower outer shell section 78 at its horizontal splitline. Additionally, the bracket 99 is secured by bolts to the periphery of the dummy shell. By operating the motor 94 of the roll cage assembly, the combined dummy shell 190 and lower inner shell section 72 are rotated on the roller assemblies 180 secured to the lower outer shell section 78. Preferably, dummy shell 190 and section 72 are jointly rotated about 60°. At that time, another bracket 99 is installed on the chain adjacent the splitline and secured by bolts to the dummy shell or lower inner shell, as applicable. The roll cage assembly then again is rotated and the process repeated until the dummy shell and lower inner shell section have been rotated a full 180°. As illustrated in FIG. 13, the position of the lower inner shell section 72 has thus been transposed with the position of the dummy shell section 190 such that the lower inner shell section 72 lies above the lower outer shell section 78. An alignment pin 191 (FIG. 14) may be inserted through the outer shell into the dummy section to prevent the dummy section from rotating within the lower outer shell section 78. The cage assembly 86 is then removed by disconnecting it from the lower outer shell section 78 at the splitline. Additionally, the lower inner shell section 72 together with its shrouds, nozzles and ancillary structure can now be removed from the dummy inner shell section 190 and from the turbine. Consequently, both upper and lower inner shell sections are removable from the turbine with the rotor in place, gaining access to various parts of the rotor, as well as to the inner shell sections for repair and maintenance.

Figure 15:
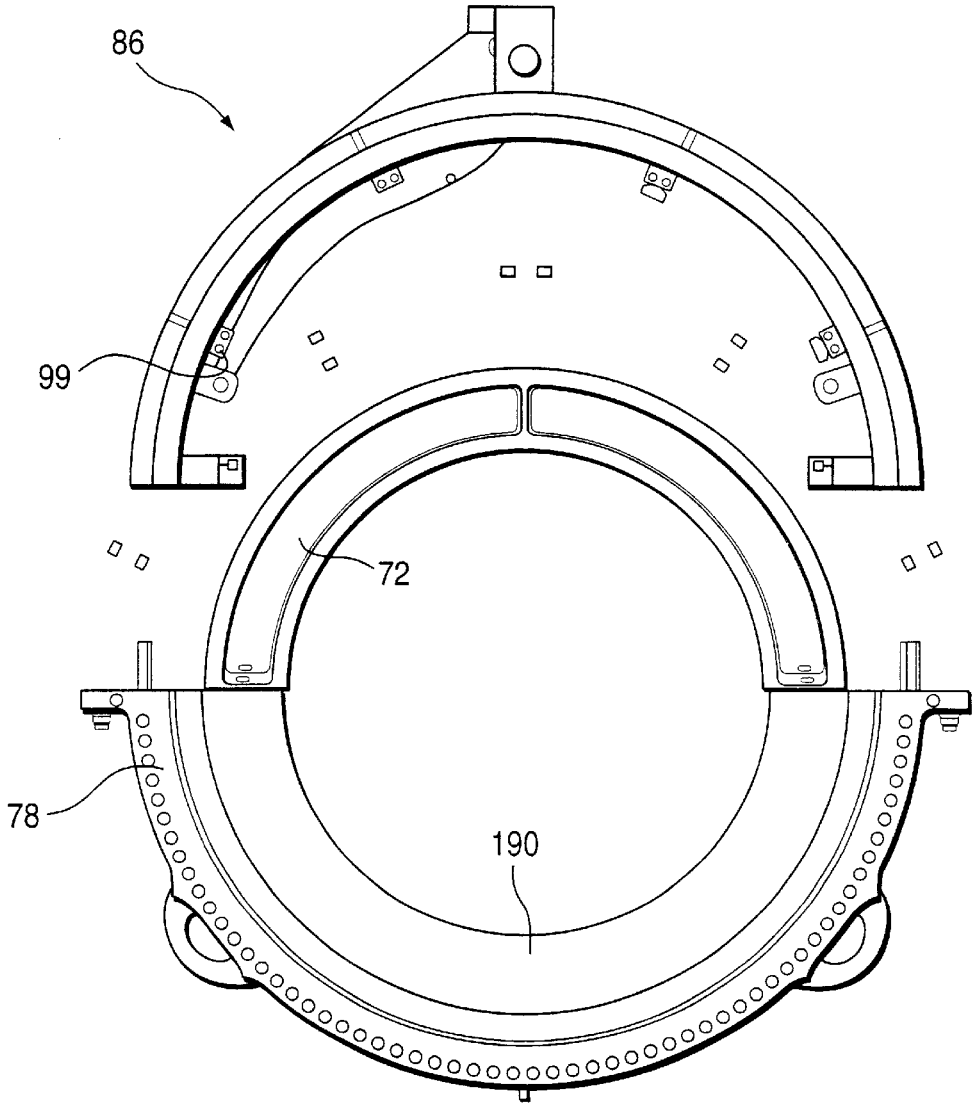
FIGS. 15–21 are schematic axial elevational views illustrating the field assembly of the inner shell and the upper out shell section.
Figure 16:
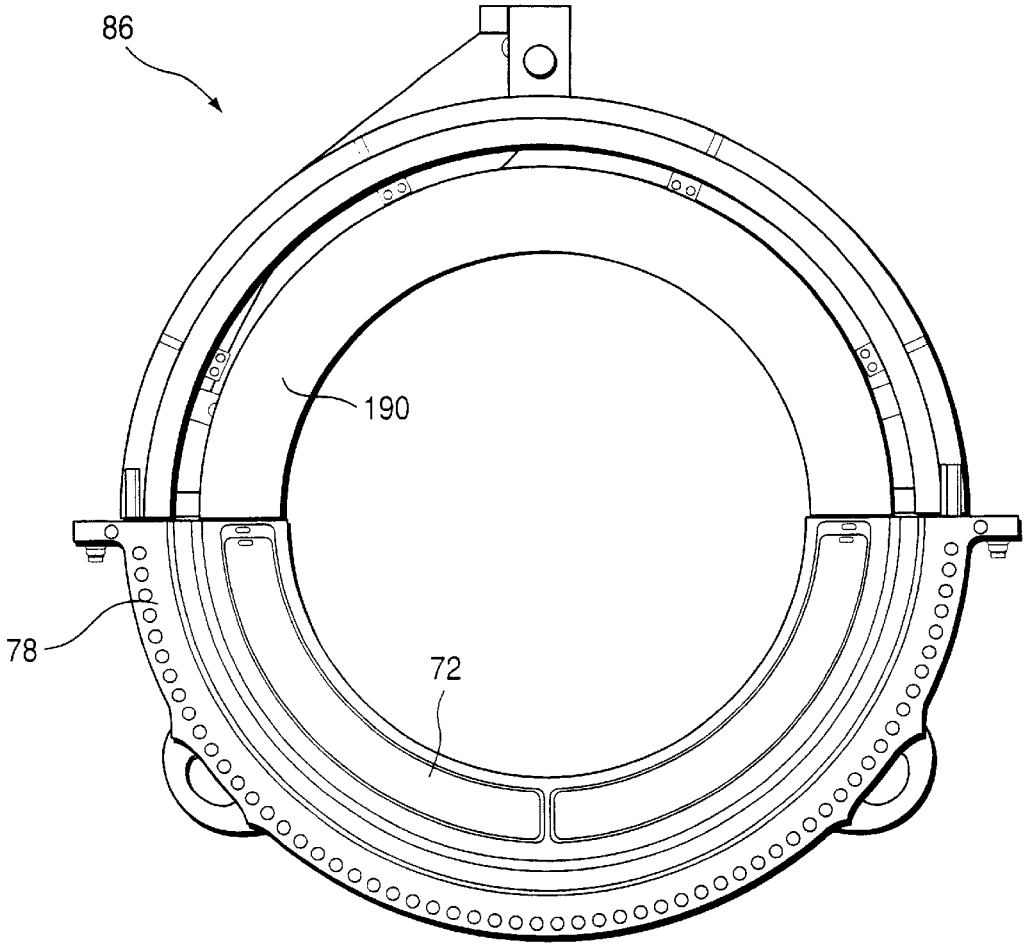

It will be appreciated that a reverse procedure is utilized to install the repaired and maintained inner shell sections into the turbine while the rotor rests in the turbine. Additional steps are also necessary to align the inner shell concentrically about the rotor axis. Referring to FIG. 15, the repaired lower inner shell half 72 is secured to the dummy inner shell 190 at the horizontal splitline, the dummy shell 190 remaining in the lower outer shell section 78 as a result of the repair. The roll cage assembly 86 is also secured to the lower outer shell section at the splitline. The bracket 99 of the roll cage assembly is secured to the rim of the lower inner shell section. The alignment pin 191 (FIG. 14) between the lower outer shell section 78 and the dummy shell section 190 is removed, freeing the dummy section 190 for rotational movement. Using the roll cage assembly, the combined lower inner shell section 72 and dummy shell 190 are stepwise rotated 180° on the roller assemblies at the 4, 5, 7 and 8 o'clock positions until the inner shell section 72 is located in the lower outer shell section 78 and the dummy shell section 190 is located above the lower outer shell section, as illustrated in FIG. 16. Once transposed, the lower inner shell section 72 is maintained in position by inserting the alignment pin 191 through the lower outer shell section into a corresponding opening in the lower inner shell section.

Figure 17:
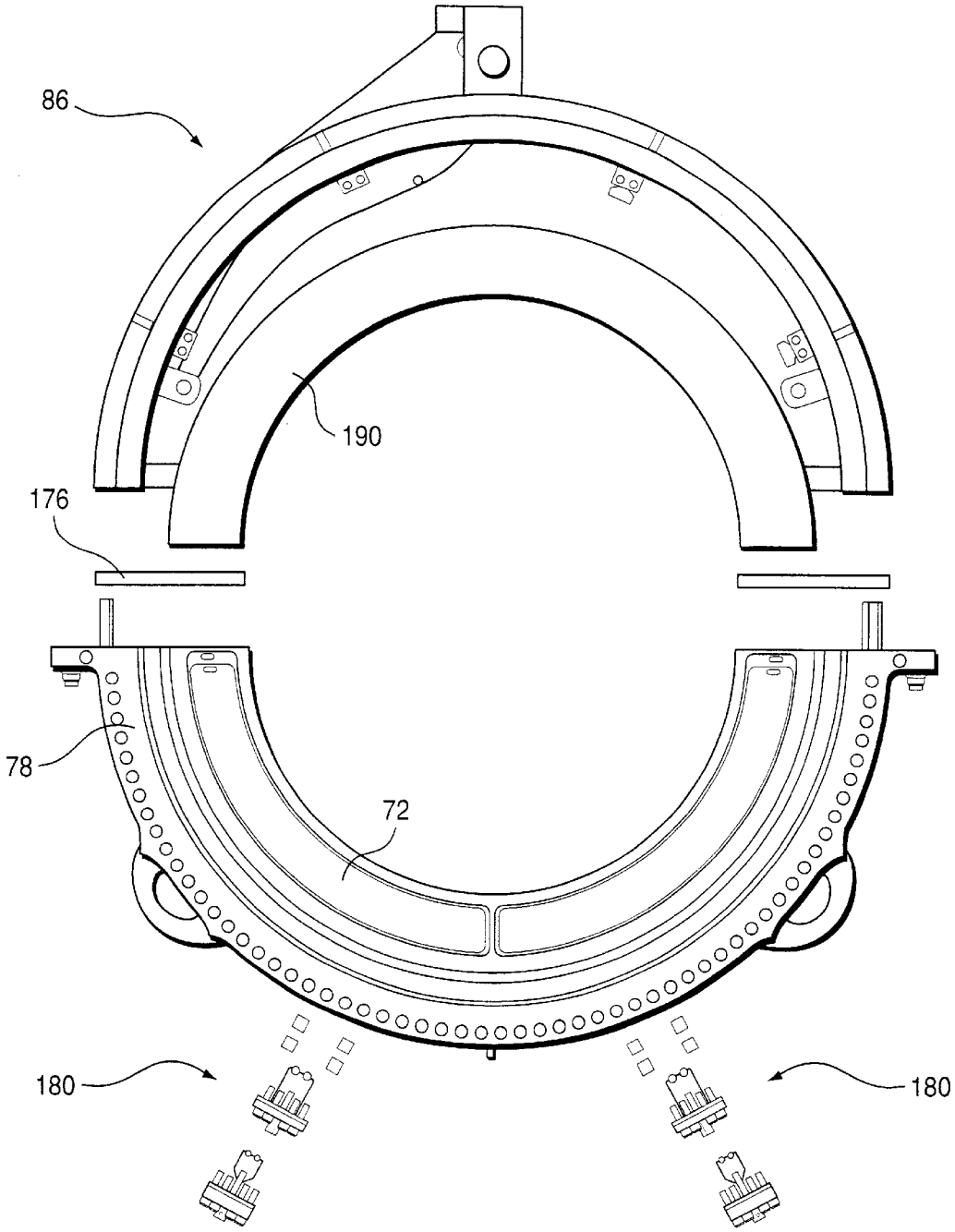

Referring to FIG. 17, the roller cage assembly 86 is disconnected from the lower outer shell 78 and removed. Similarly, the dummy shell section 190 is disconnected from the lower inner shell section 72 at the horizontal splitline and removed. As further illustrated in FIG. 17, the roll assemblies 180 for each of the forward and aft portions of the inner shell at the 5 and 7 o'clock positions are removed together with their inserts. It will be appreciated that, at this stage, the lower inner shell section 72 remains supported by the roller assemblies at the 4 and 8 o'clock positions. Also, the splitline support plates 176 are applied at the splitlines of both the inner and outer lower shell sections.

Figure 18:
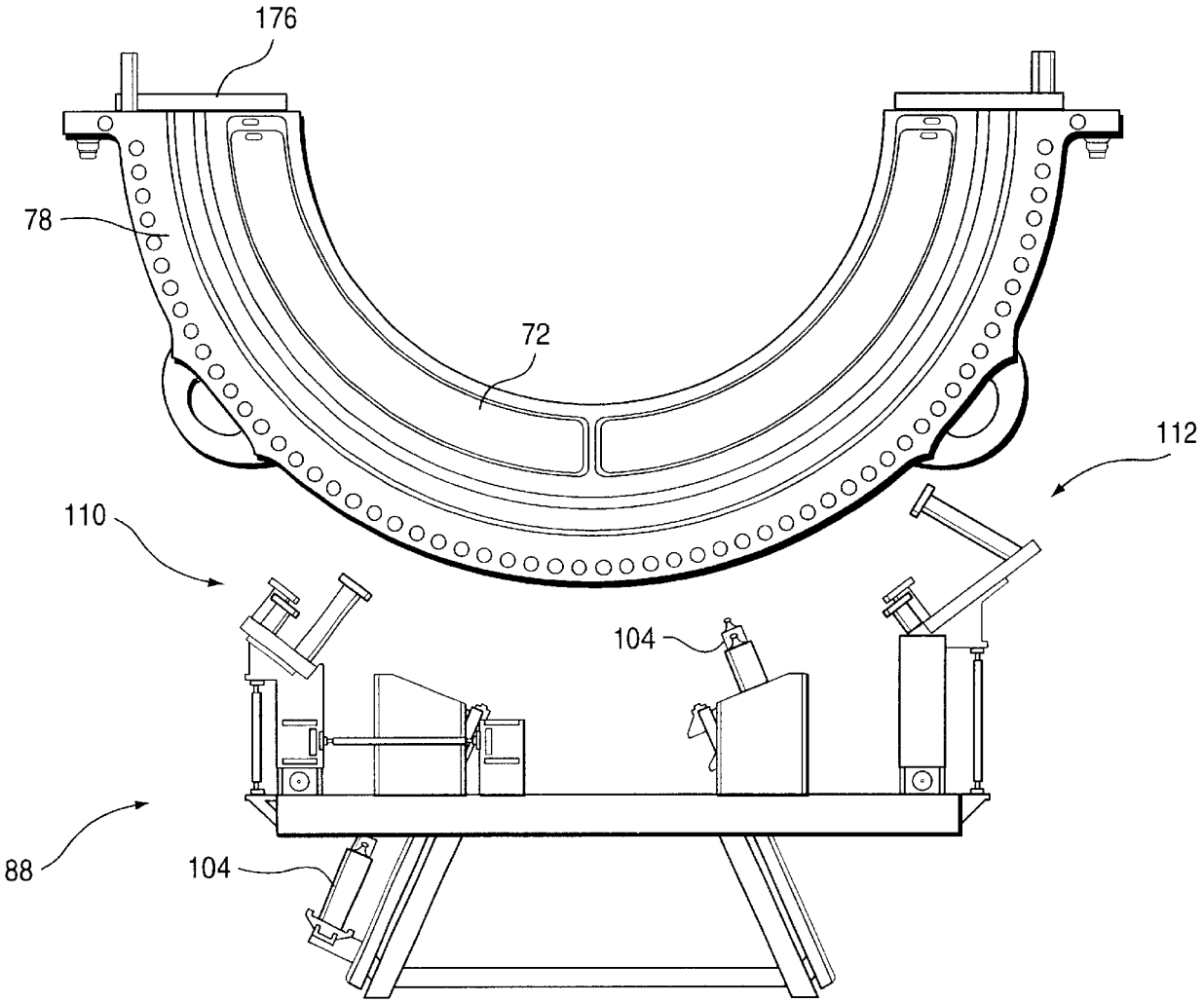
Figure 19:
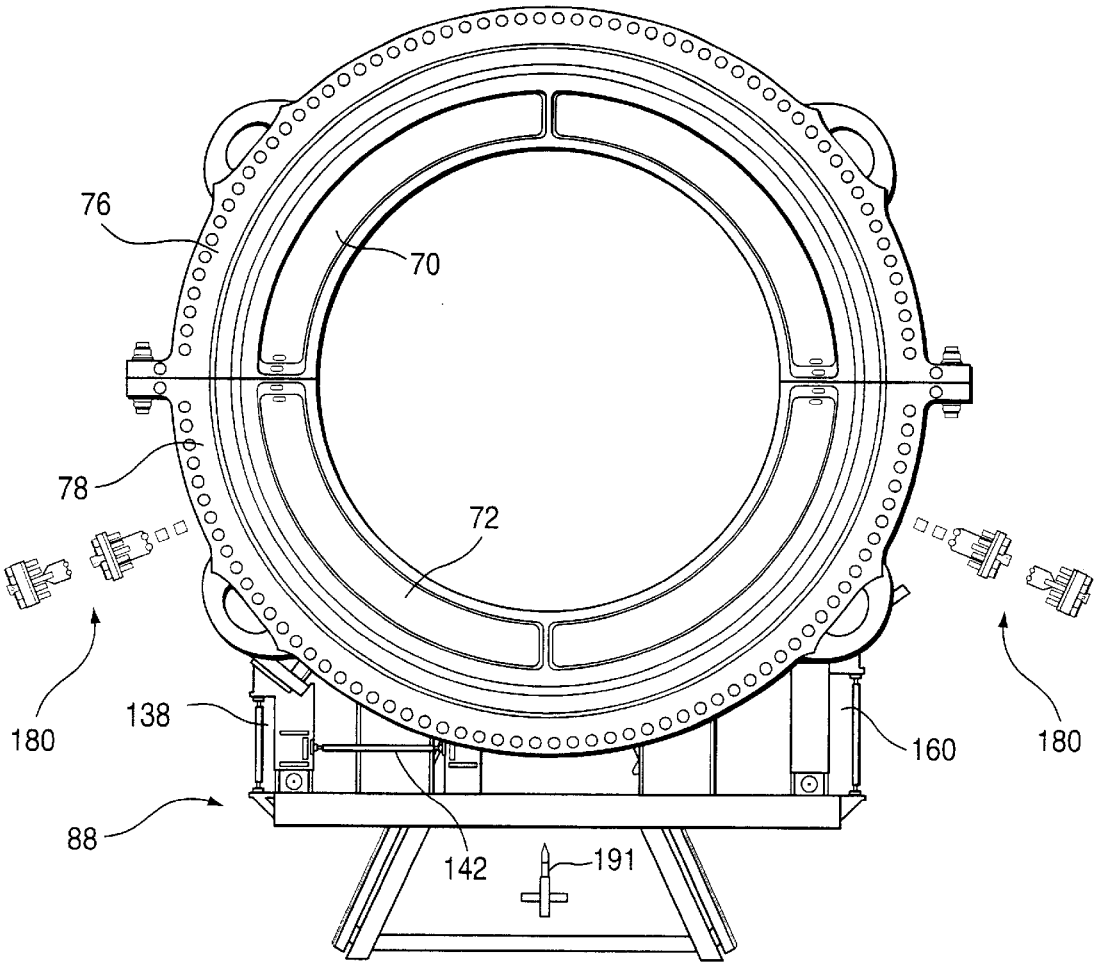

Referring to FIG. 18, the alignment structure 88 is next installed onto the lower outer shell section 78. That is, the bolt circle flanges of the left and right-hand mounts 110 and 112, respectively, are bolted to corresponding bolt circle flanges on the lower outer shell section 78 supporting the alignment frame from the outer shell section. Additionally, the cradle pins 104 are advanced in the support hole openings vacated by the roller assemblies 180 at the 5 and 7 o'clock positions to again engage in the recesses 50 and 52 of the forward and aft portions of the inner shell. The splitline support plates 176 are then removed from opposite sides of the outer lower shell section 78. The roller assemblies 180 at the 4 and 8 o'clock positions, both fore and aft, are also removed (see FIG. 19). It will be appreciated that the weight of the lower inner shell section 72 is thus transferred to the cradle pins 104 and to the lower outer shell section 78 via the alignment structure 88 supported by the lower outer shell section 78. The upper inner shell section 70 is then installed by securing it to the lower inner shell section along the horizontal splitline.

By manipulating the adjusting rods of the alignment structure, the inner shell can be located vertically and horizontally in a radial plane, displaced axially and inclined or canted. At this stage of the installation, it will be appreciated that the entire inner shell is supported on the four cradle pins 104 of the alignment structure 88 and that the alignment structure, in turn, is supported solely by the lower outer shell section 78. To displace the inner shell relative to the outer shell in a vertical direction, the vertically extending adjusting rods 138, 140, 160 and 162 are rotated and hence threaded to displace the frame 100 relative to the mounts 110 and 112. This displacement, in turn, displaces the cradle pins 104 and the inner shell carried thereby vertically relative to the outer shell. To effect a lateral or transverse movement, the adjusting rod 126 is rotated and hence threaded, causing the cradle pins 104 to shift laterally relative to the mounts 110 and 112. Because the cradle pins carry the inner shell, the inner shell is shifted laterally relative to the lower outer shell section 78 by the adjusting rod 126. To displace the inner shell axially, the adjusting rods 128 and 152 are screwthreaded, causing the frame 100 to be displaced axially relative to the mounts 110 and 112. Consequently, the cradle pins 104 also carry the inner shell for axial displacement relative to the outer shell. By differentially adjusting the fore and aft vertical rods 138, 160 and 140, 162, respectively, the inner shell can be inclined relative to the outer shell.

Figure 20:
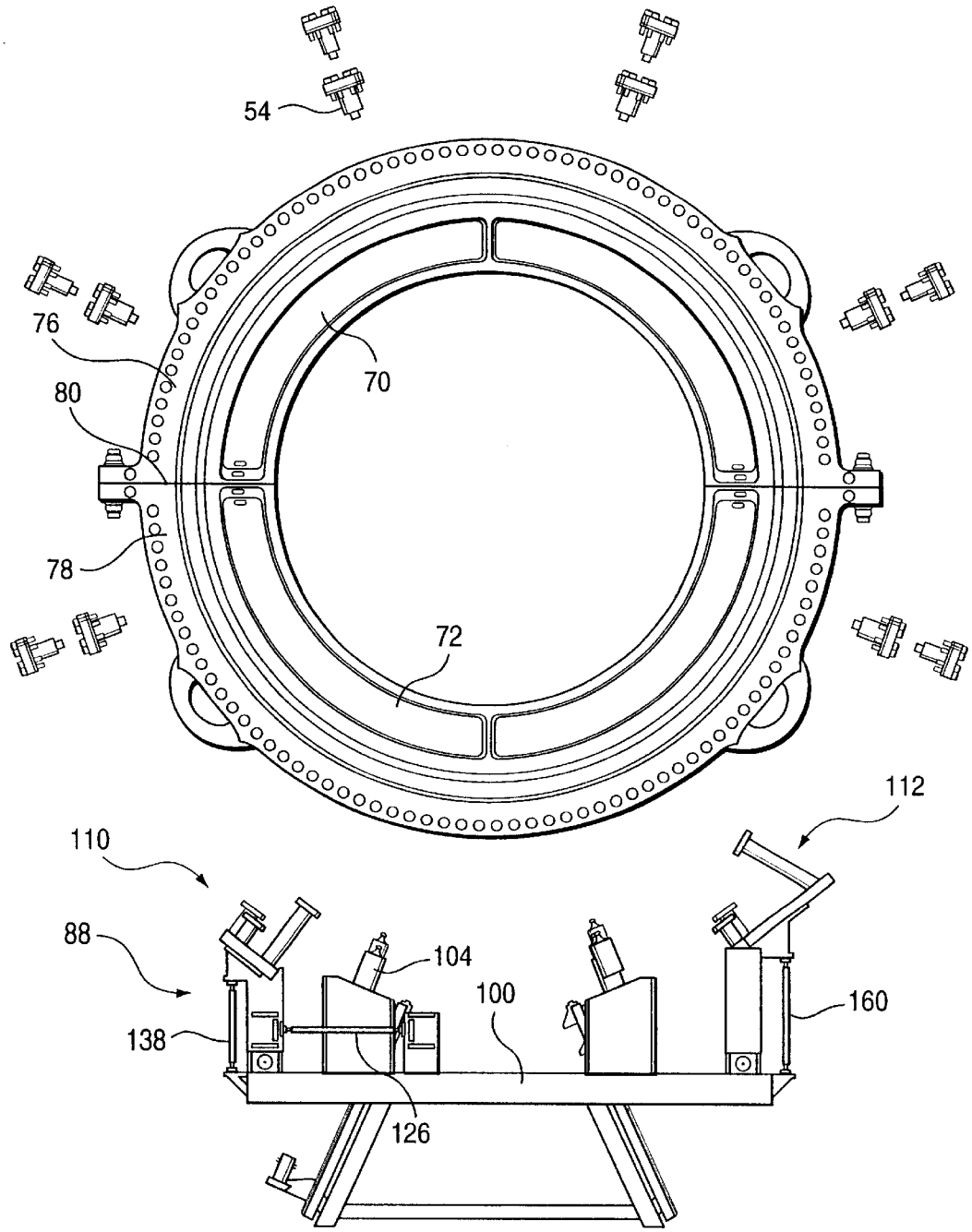
Figure 21:
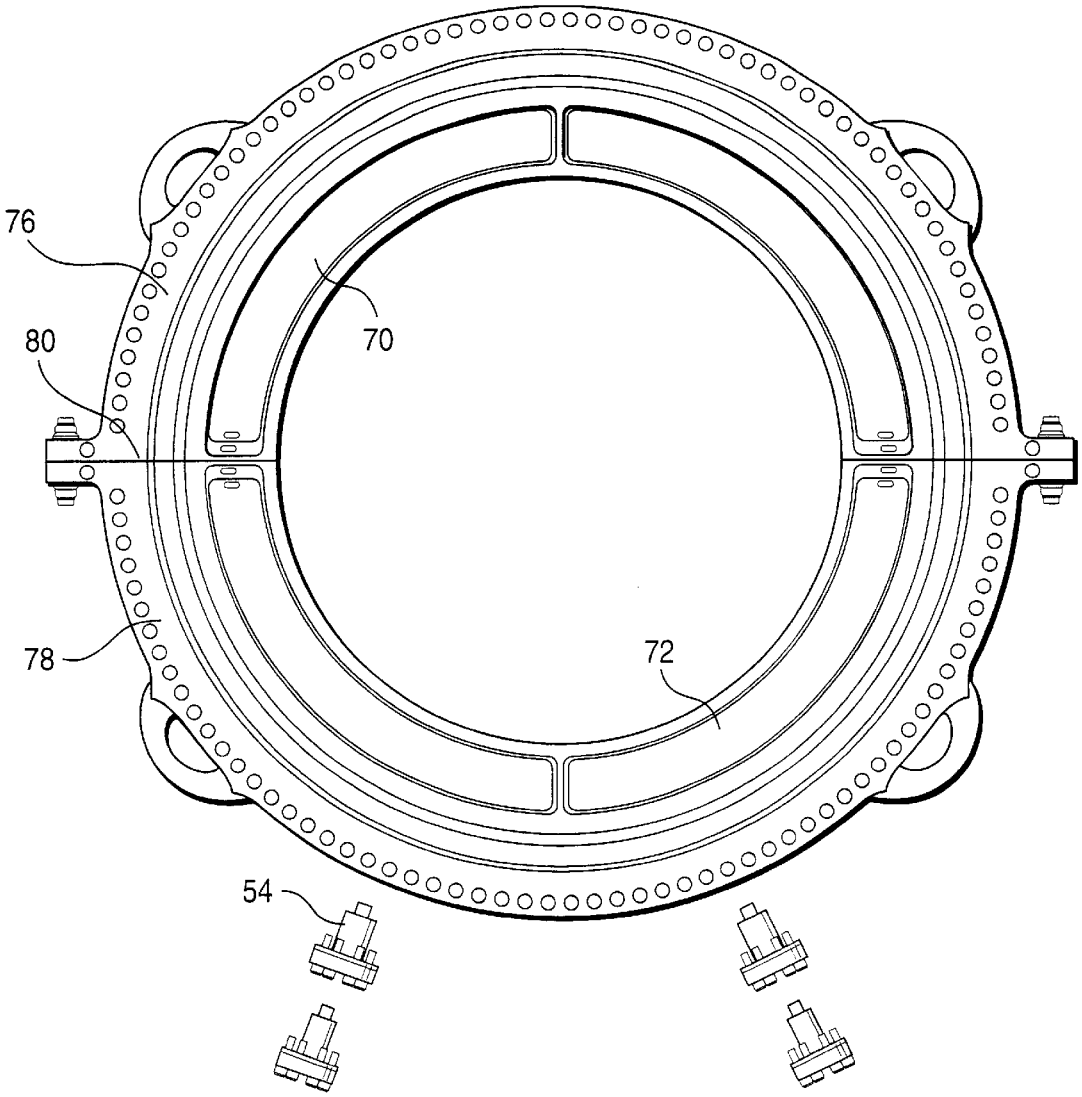

When the alignment of the inner shell is completed relative to the lower outer shell section 78 and the rotor axis, the upper outer shell 76 is installed and secured to the lower outer shell section 78 along the horizontal splitline (see FIG. 20). The support pins 54 are then inserted into the outer shell at the 4, 8, 10, 11, 1 and 2 o'clock positions to fix the inner shell in its adjusted aligned position relative to the outer shell. With the inner shell fixed, the cradle pins 104 are withdrawn from the inner shell. The alignment structure 88 is then removed by removing the mounts 110 and 112 from the lower outer shell section (see FIG. 20). Once the alignment fixture 88 has been removed, the final support pins 54 are inserted at the fore and aft 5 and 7 o'clock positions to engage between the lower outer shell and the lower inner shell, as illustrated in FIG. 21.

Figure 22:
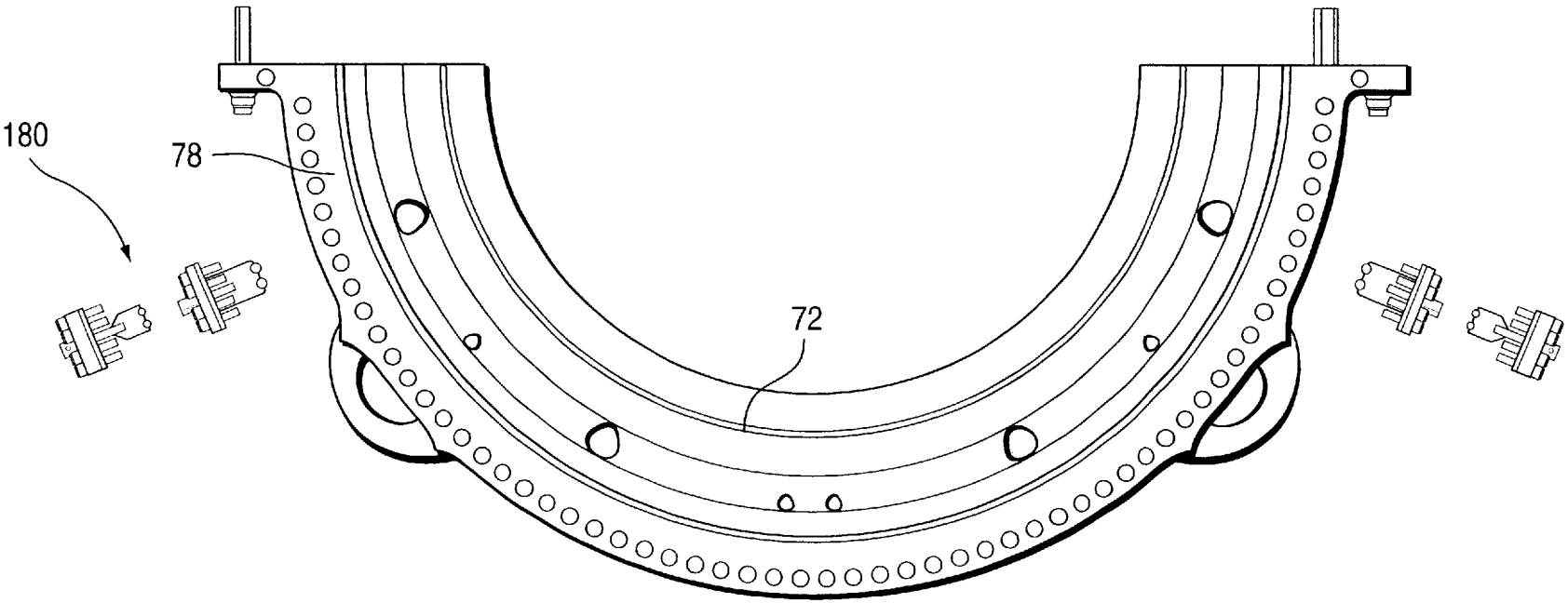
FIGS. 22–26 are schematic axial elevational views illustrating factory assembly of the turbine.
Figure 23:
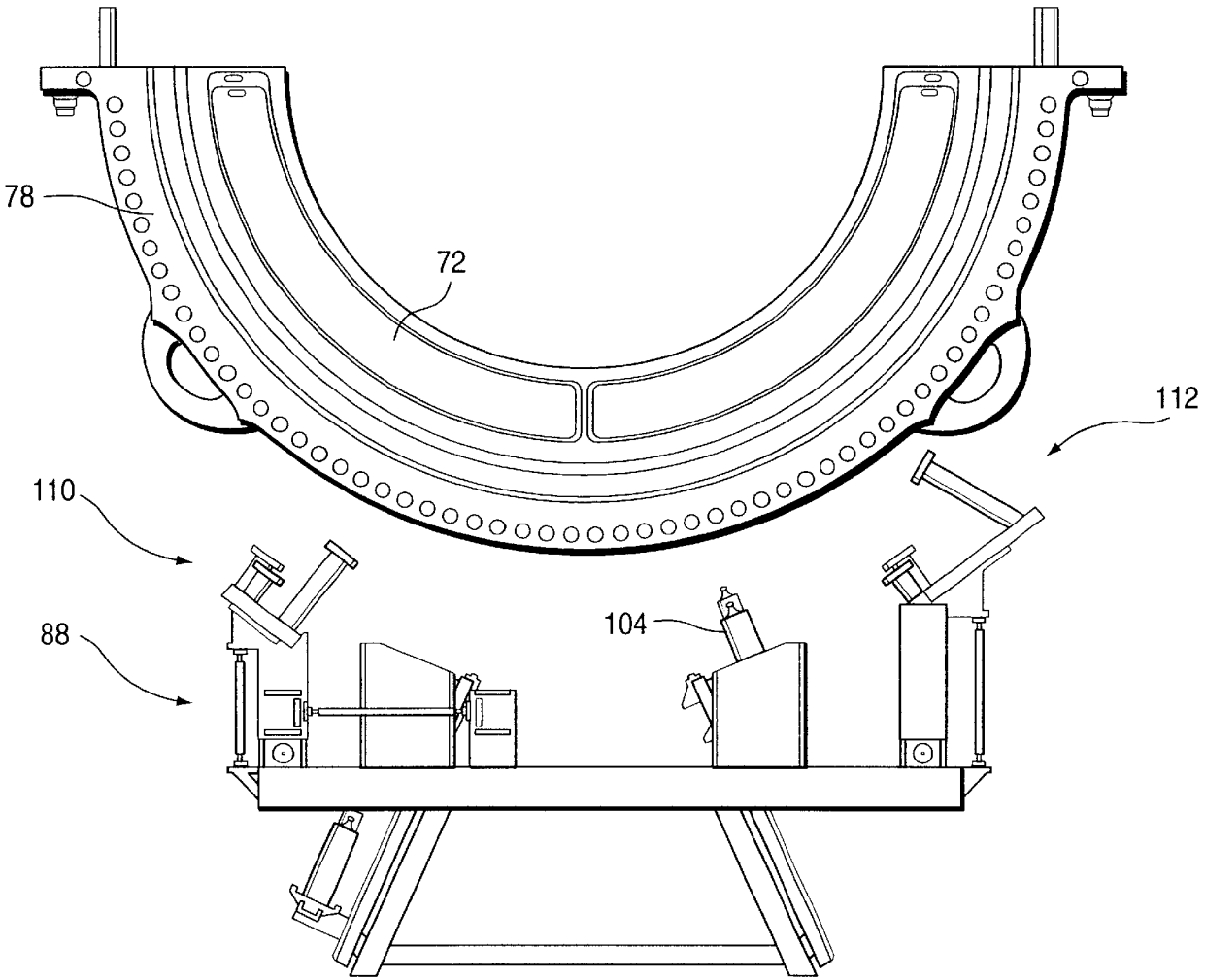

The foregoing disassembly and assembly procedures have been described with respect to an existing turbine, for example, a turbine in the field in need of maintenance or repair. The alignment fixture may also be utilized for initial manufacture of the turbine. Thus, referring to FIG. 22, there is illustrated the lower outer shell section 78 with the roller assemblies 180 inserted into the lower outer shell access openings at the 4 and 8 o'clock positions. The access openings at the 5 and 7 o'clock positions remain open. The lower inner shell section 72 may then be lowered into the lower outer shell section 78 and supported on the roller assemblies 180 at the 4 and 8 o'clock positions. Referring to FIG. 23, the alignment fixture 88 is then secured to the lower outer shell section 78 by bolting the left and right-hand mounts 110 and 112, respectively, to the bolt circles on the lower outer shell section 78. The cradle pins 104 may then be driven upwardly through the vacant access openings in the lower outer shell section 78 to engage in the recesses 50 and 52 of the lower inner shell section 72. At this stage of the factory installation procedure, the rotor may be installed into the lower half of the turbine shell.

Figure 24:
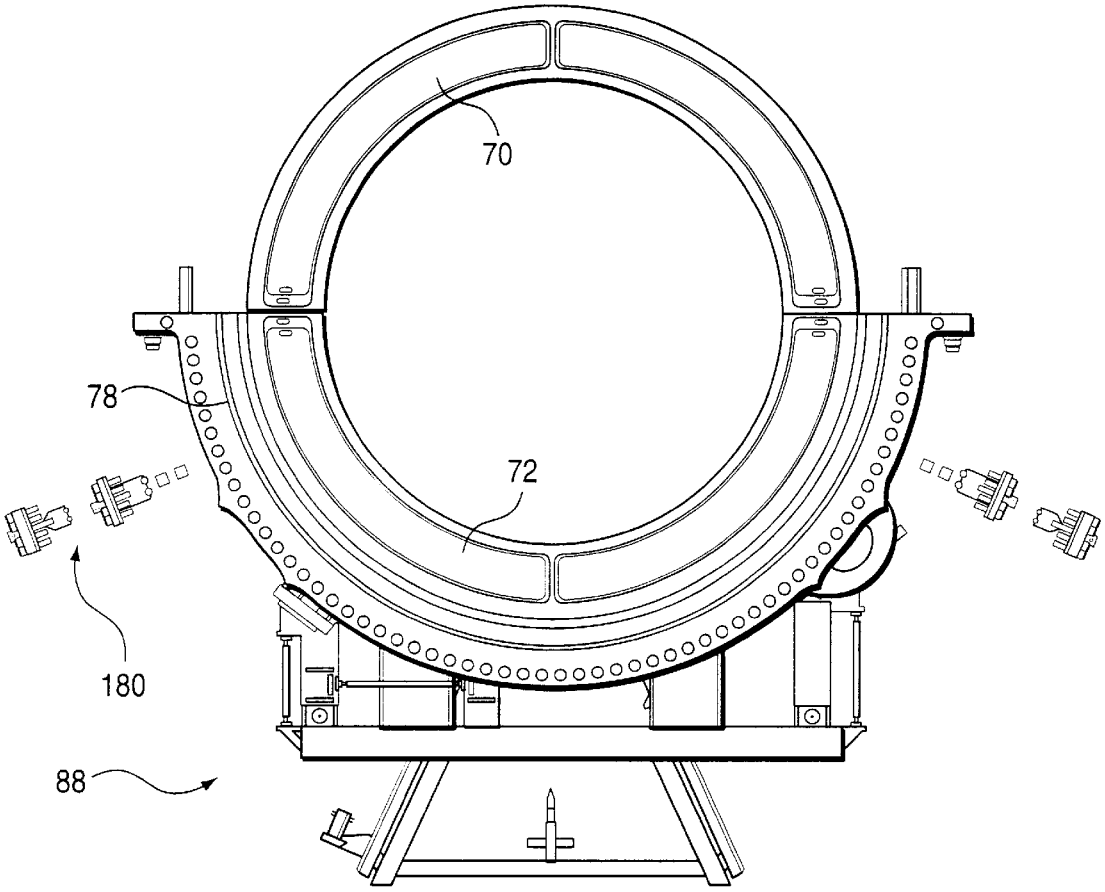

Referring to FIG. 24 and with the rotor installed in the lower half of the turbine shell, the upper inner shell section 70 is lowered and secured to the lower inner shell section 72 at the horizontal splitline. With the inner shell sections 70 and 72 secured together, the roller assemblies 180 at the 4 and 8 o'clock positions are removed. Their removal transfers the weight of the entire inner shell to the cradle pins 104 of the alignment fixture. Thus, the entire inner shell is supported by the lower outer shell section 78 through the alignment fixture 88 and the cradle pins 104 inserted in the recesses 50 and 52. With the upper outer shell section 76 removed, the inner shell can now be adjusted longitudinally, laterally, vertically and about a transverse axis by manipulation of the adjusting rods similarly as previously described with respect to the field assembly procedure.

Figure 25:
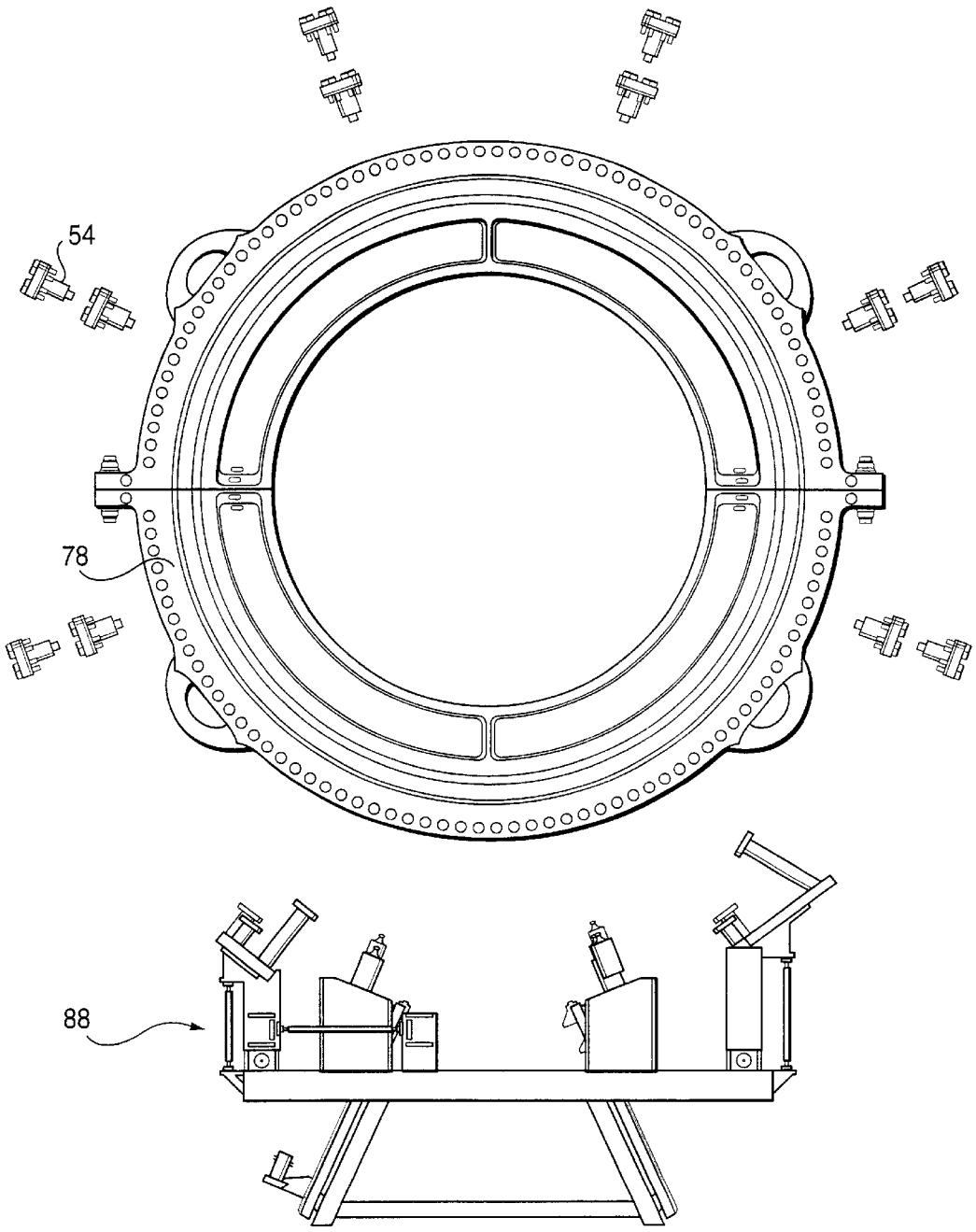
Figure 26:
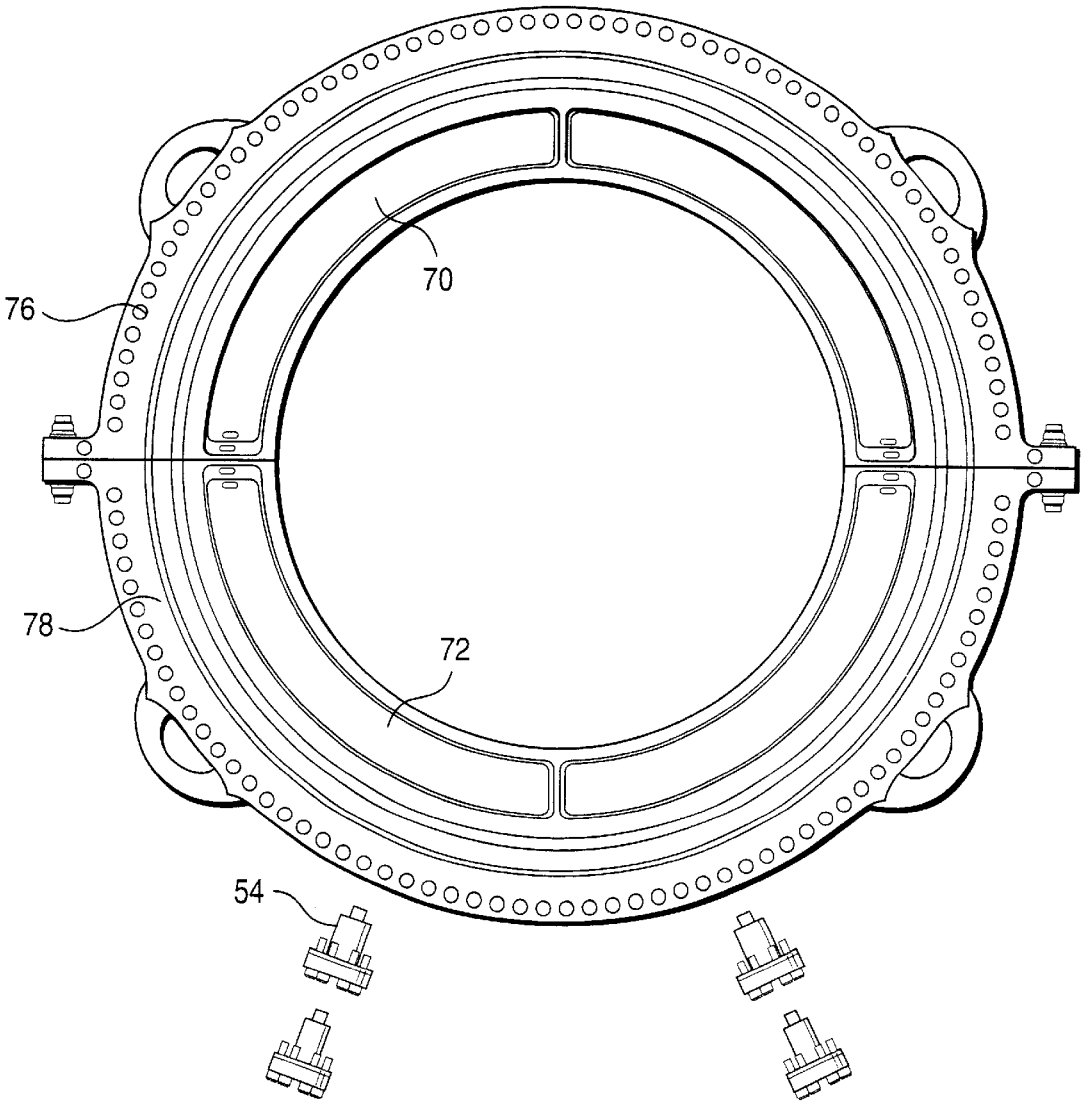

Referring to FIG. 25, and with the inner shell adjusted relative to the lower outer shell section, the upper outer shell section is secured to the lower outer shell section at the horizontal splitline. Also, with the alignment fixture 88 secured to the lower outer shell section 78, and the inner shell in adjusted position, the support pins 54 are inserted at the 1, 2, 4, 8, 10 and 11 o'clock positions as illustrated. The pins are secured to the corresponding outer shell sections with their pin projections residing in the recesses or sockets of the inner shell. With the support pins 54 in the foregoing described locations, the cradle pins 104 of the alignment fixture 88 can be withdrawn from the recesses of the inner shell. The weight of the inner shell is transferred to the support pins. The alignment fixture 88 is then removed from the lower outer shell section 78 by unbolting the mounts 110 and 112 from the lower outer shell section 78. As illustrated in FIG. 26, the pins 54 at the 5 and 7 o'clock positions are then inserted into the now-vacant access openings in the lower outer shell section 78 to engage in the corresponding recesses of the inner shell, thus completing the assembly of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a turbine having arcuate inner and outer shells and a rotor within said outer and inner shells having an axis, a method for aligning the inner and outer shells relative to one another, comprising the steps of:

(a) supporting an alignment fixture having a pair of mounts and a frame movable relative to said mounts from said outer shell by fixing said mounts to said outer shell;

(b) supporting said inner shell within said outer shell by said alignment fixture by fixing said mounts to said outer shell; and (c) adjusting said inner shell relative to said outer shell by moving said mounts and said frame relative to one another.

2. A method according to claim 1 wherein the step of adjusting includes displacing the inner shell relative to the outer shell in a plane perpendicular to the axis of the rotor.

3. A method according to claim 1 wherein the step of adjusting includes displacing the inner shell relative to the outer shell in a direction parallel to said axis.

4. A method according to claim 1 wherein the step of adjusting includes displacing said inner shell relative to said outer shell about an axis perpendicular to the rotor axis.

5. A method according to claim 1 wherein the step of adjusting includes displacing the inner shell relative to the outer shell in planes perpendicular and parallel to the rotor axis.

6. A method according to claim 1 including passing support members carried by said frame through openings in said outer shell for engaging said inner shell and supporting said inner shell by said frame.

7. A method according to claim 1 including subsequent to step (c), transferring support of said inner shell from said alignment fixture to said outer shell.

8. A method of disassembling a turbine having a pair of arcuate upper and lower outer shell sections and a pair of arcuate upper and lower inner shell sections concentric about a rotor having an axis and without removing the rotor from the turbine, comprising the steps of:

(a) removing the upper outer shell section;

(b) removing the upper inner shell section;

(c) supporting a fixture from said lower outer shell section;

(d) transferring support of said lower inner shell section from said lower outer shell section to said fixture;

(e) subsequent to step (c), securing roller assemblies to said lower outer shell section for engaging said lower inner shell section;

(f) transferring support for said lower inner shell section from said fixture to said roller assemblies and said lower outer shell section;

(g) rotating said lower inner shell section about said axis to a location above said lower outer shell section; and (h) subsequent to step (g), removing said lower inner shell section.

9. A method according to claim 8 wherein the inner and outer shell sections are initially secured to one another by an array of circumferentially spaced connecting elements engaging between said inner and outer shell sections including, prior to steps (a) and (b), disengaging the elements engaging between said upper outer shell section and said upper inner shell section; prior to step (c), removing certain but not all elements engaging between said lower outer shell section and said lower inner shell section, leaving access openings through said lower outer shell; and inserting support members carried by said fixture through said access openings to engage and support said lower inner shell section by said fixture.

10. A method according to claim 8 including subsequent to step (e), removing said support members from supporting engagement with said lower inner shell section through said access openings and securing additional roller assemblies to said lower outer shell section and in said access opening for engagement with said lower inner shell section.

11. A method according to claim 8 including, prior to step (g), securing a dummy inner shell section to said lower inner shell section, and rotating said lower inner shell section and said dummy section about said axis to locate said lower inner shell section about said lower outer shell section and said dummy section in said lower outer shell section.

12. A method according to claim 11 including reassembling the turbine, the step of reassembling the turbine including securing said lower inner shell section to said dummy section in a location above said outer shell section, rotating said dummy shell and said lower inner shell section to locate said lower inner shell section within said lower outer shell section and said dummy section above said lower outer shell section, removing said dummy section, securing said upper inner shell section to said lower inner shell section and securing said upper outer shell section to said lower outer shell section.

13. An alignment fixture for securement to an outer shell of a turbine having inner and outer shells secured to one another about a rotor having an axis, comprising:

a pair of mounts for securement to the outer shell;

a frame having support members movable thereon between (i) a support position passing through access openings of the outer shell and in engagement with the inner shell to support the inner shell from the frame and (ii) a non-support position spaced from the inner shell; and at least one adjustable element interconnecting said frame and at least one of said mounts for adjusting the position of the frame relative to the outer shell in one of an axial direction or in a plane normal to the axis of the rotor, when said support members lie in said support position, thereby adjusting the inner shell relative to the outer shell.

14. A fixture according to claim 13 including a pair of said elements connected to said mounts, respectively, and said frame, whereby adjustment of one of said elements causes movement of said frame to adjust the inner shell relative to the outer shell in said plane normal to the rotor axis.

15. A fixture according to claim 13 wherein said one element is connected between one of said mounts and said frame on one side of a vertical plane through the rotor axis, another element connected between another of said mounts and said frame on an opposite side of said frame from said one element, whereby adjustment of one of said elements causes movement of said frame to adjust the inner shell relative to the outer shell in said plane normal to the rotor axis.

16. A fixture according to claim 13 wherein said one element adjusts the position of the frame relative to the outer shell in said axial direction, another element interconnecting said frame and one of said mounts for adjusting the position of the frame relative to the outer shell in said plane normal to the axis of the rotor.

17. A method according to claim 1 wherein step (b) includes displacing a pair of support members along said frame into engagement with said inner shell.

18. A method according to claim 17 wherein the step of adjusting includes displacing the inner shell relative to the outer shell in a plane perpendicular to the axis of the rotor, in a direction parallel to said axis and about an axis perpendicular to the rotor axis.

19. A method according to claim 1 wherein step (c) includes moving said mounts and said frame relative to one another externally of said outer shell.

20. An alignment fixture for securement to an outer shell of a turbine having inner and outer shells secured to one another about a rotor having an axis, comprising:

a pair of mounts for securement to the outer shell;

a frame having support members movable thereon between (i) a support position passing through access openings of the outer shell and in engagement with the inner shell to support the inner shell from the frame and (ii) a non-support position spaced from the inner shell; and a first pair of axially spaced forward and aft elements connected between one of said mounts and said frame on one side of a vertical plane through said rotor axis, a second pair of axially spaced forward and aft elements connected between another of said mounts on an opposite side of said vertical axis, whereby differential adjustment of said forward and aft elements, respectively, causes movement of said frame to incline the inner shell relative to the outer shell in said vertical plane.

21. A fixture according to claim 20 including a further element connected between one of said mounts and said frame for adjusting the position of the frame relative to the outer shell in an axial direction.

22. An alignment fixture for securement to an outer shell of a turbine having inner and outer shells secured to one another about a rotor having an axis, comprising:

a pair of mounts for securement to the outer shell;

a frame having support members movable thereon between (i) a support position passing through access openings of the outer shell and in engagement with the inner shell to support the inner shell from the frame and (ii) a non-support position spaced from the inner shell; and a first pair of axially spaced forward and aft elements connected between one of said mounts and said frame on one side of a vertical plane through said rotor axis, a second pair of axially spaced forward and aft elements connected between one of said mounts and said frame on an opposite side of said vertical plane for adjusting the position of the frame relative to the outer shell thereby adjusting the inner shell relative to the outer shell, a fifth element connected between one of said mounts and said frame for adjusting the position of the frame relative to the outer shell in one of axial and lateral directions thereby adjusting the inner shell relative to the outer shell in one of said axial and lateral directions.

23. A fixture according to claim 21 wherein said fifth element adjusts the position of the frame relative to the outer shell to adjust the position of the inner shell relative to the outer shell in an axial direction and a sixth element connected between one of said mounts and said frame for adjusting the position of the frame relative to the outer shell to adjust the position of the inner shell relative to the outer shell in a direction normal to said axial direction.

* * * * *